US011448433B2

(12) United States Patent
Takegami et al.

(10) Patent No.: US 11,448,433 B2
(45) Date of Patent: Sep. 20, 2022

(54) REFRIGERATION APPARATUS

(71) Applicant: DAIKIN INDUSTRIES, LTD., Osaka (JP)

(72) Inventors: Masaaki Takegami, Osaka (JP); Yoshikazu Uehara, Osaka (JP); Shuichi Taguchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 17/572,285

(22) Filed: Jan. 10, 2022

(65) Prior Publication Data

US 2022/0128275 A1 Apr. 28, 2022

Related U.S. Application Data

(63) Continuation of application No. PCT/JP2020/025152, filed on Jun. 26, 2020.

(30) Foreign Application Priority Data

Jul. 18, 2019 (JP) ..... JP2019-133085

(51) Int. Cl.
*F25B 13/00* (2006.01)
*F25B 9/00* (2006.01)

(52) U.S. Cl.
CPC ..... *F25B 13/00* (2013.01); *F25B 9/008* (2013.01); *F25B 2309/061* (2013.01);
(Continued)

(58) Field of Classification Search
CPC .... F25B 13/00; F25B 9/008; F25B 2309/061; F25B 2700/1931; F25B 2700/21152;
(Continued)

(56) References Cited

U.S. PATENT DOCUMENTS

2009/0013700 A1 1/2009 Unezaki et al.
2010/0000245 A1 1/2010 Kasahara et al.
(Continued)

FOREIGN PATENT DOCUMENTS

EP 2 837 898 A1 2/2015
EP 3 054 231 A1 8/2016
(Continued)

OTHER PUBLICATIONS

International Search Report for PCT/JP2020/025152 dated Sep. 8, 2020.
(Continued)

*Primary Examiner* — Henry T Crenshaw
(74) *Attorney, Agent, or Firm* — Birch, Stewart, Kolasch & Birch, LLP

(57) ABSTRACT

A refrigerant circuit of a refrigeration apparatus performs a refrigeration cycle in which a high pressure is equal to or greater than the critical pressure of a refrigerant. The refrigeration apparatus performs at least a heat application operation in which an indoor heat exchanger of the refrigerant circuit functions as a radiator. A controller of the refrigeration apparatus controls the opening degree of the indoor expansion valve of the refrigerant circuit so that the temperature of the refrigerant at the outlet of the indoor heat exchanger reaches a predetermined reference temperature, in the heat application operation.

5 Claims, 9 Drawing Sheets

(52) U.S. Cl.
CPC ..... *F25B 2313/02732* (2013.01); *F25B 2600/2513* (2013.01); *F25B 2700/1931* (2013.01); *F25B 2700/1933* (2013.01); *F25B 2700/21152* (2013.01)

(58) Field of Classification Search
CPC ..... F25B 2313/023; F25B 2313/0233; F25B 2313/027
See application file for complete search history.

(56) References Cited

U.S. PATENT DOCUMENTS

2010/0326125 A1* 12/2010 Sakae ..... F25B 31/004 62/470
2011/0000239 A1* 1/2011 Okamoto ..... F25B 9/008 62/203
2011/0061413 A1* 3/2011 Setoguchi ..... F25B 1/10 62/238.7
2011/0297363 A1* 12/2011 Takata ..... F24F 3/06 165/270
2013/0227977 A1* 9/2013 Morimoto ..... F25B 49/005 62/190
2015/0128629 A1* 5/2015 Kawano ..... F25B 13/00 62/503
2020/0378642 A1 12/2020 Shimizu et al.

FOREIGN PATENT DOCUMENTS

JP 2006-153349 A 6/2006
JP 2008-64439 A 3/2008
JP 2012-137281 A 7/2012
JP 2013-92292 A 5/2013
JP 2013-92293 A 5/2013
JP 2018-138841 A 9/2018
WO WO 2013/145005 A1 10/2013

OTHER PUBLICATIONS

Written Opinion of the International Searching Authority for PCT/JP2020/025152 dated Sep. 8, 2020.
English translation of International Preliminary Report on Patentability and Written Opinion of the International Searching Authority for International Application No. PCT/JP2020/025152, dated Jan. 27, 2022.
Extended European Search Report dated Jul. 5, 2022 in counterpart European Application No. 20840512.6.

* cited by examiner

REFRIGERATION-FACILITY OPERATION

COOLING OPERATION

COOLING/REFRIGERATION-FACILITY OPERATION

HEATING OPERATION

HEATING/REFRIGERATION-FACILITY OPERATION

HEATING/REFRIGERATION-FACILITY HEAT RECOVERY OPERATION

HEATING/REFRIGERATION-FACILITY RESIDUAL HEAT OPERATION

REFRIGERATION APPARATUS

CROSS REFERENCE TO RELATED APPLICATIONS

This application is a Continuation of PCT International Application No. PCT/JP2020/025152, filed on Jun. 26, 2020, which claims priority under 35 U.S.C. 119(a) to Patent Application No. 2019-133085, filed in Japan on Jul. 18, 2019, all of which are hereby expressly incorporated by reference into the present application.

TECHNICAL FIELD

The present disclosure relates to a refrigeration apparatus.

BACKGROUND ART

An air-conditioning device that performs a refrigeration cycle where the high pressure reaches equal to or greater than the critical pressure of the refrigerant has been known in the art. The refrigeration apparatus disclosed in Patent Document 1 includes a plurality of indoor units that perform cooling and heating of a room. When the indoor units perform heating, the refrigerant in an indoor heat exchanger of each of the indoor units dissipates heat to air. While the indoor unit performs a heating operation, the opening degree of an expansion valve is controlled so that the temperature of the refrigerant at an outlet of the indoor heat exchanger of the indoor unit reaches a target temperature.

CITATION LIST

Patent Document

PATENT DOCUMENT 1: Japanese Unexamined Patent Publication No. 2008-64439

SUMMARY

A first aspect of the present disclosure is directed to a refrigeration apparatus including: a refrigerant circuit (6) that includes a compressor (21, 22, 23), a heat-source-side heat exchanger (13), and a plurality of utilization-side units (60*a* to 60*c*) each including an utilization-side heat exchanger (64*a* to 64*c*) and an expansion valve (63*a* to 63*c*) and arranged in parallel, the refrigerant circuit (6) being configured to perform a refrigeration cycle where a high pressure is equal to or greater than a critical pressure of a refrigerant, the refrigeration apparatus being configured to perform at least a heat application operation in which the utilization-side heat exchanger (64*a* to 64*c*) functions as a radiator. The plurality of utilization-side units (60*a* to 60*c*) are capable of separately setting respective set temperatures, and the refrigeration apparatus further includes a controller (100) configured to set a reference temperature higher than the highest set temperature among the set temperatures for the plurality of utilization-side units (60*a* to 60*c*), and separately control an opening degree of the expansion valve (63*a* to 63*c*) of each of the plurality of utilization-side units (60*a* to 60*c*) so that a temperature of the refrigerant at an outlet of the utilization-side heat exchanger (64*a* to 64*c*) of each of the plurality of utilization-side units (60*a* to 60*c*) reaches the reference temperature, in the heat application operation.

DESCRIPTION OF EMBODIMENTS

Hereinafter, embodiments will be described with reference to the drawings.

A refrigeration apparatus (1) according to the present embodiment is configured such that cooling an object to be cooled and air-conditioning an indoor space are performed in parallel. The object to be cooled herein includes air in facilities such as a refrigerator, a freezer, and a show case. Hereinafter, such facilities are each referred to as a refrigeration facility.

—General Configuration of Refrigeration Apparatus—

Figure 1:
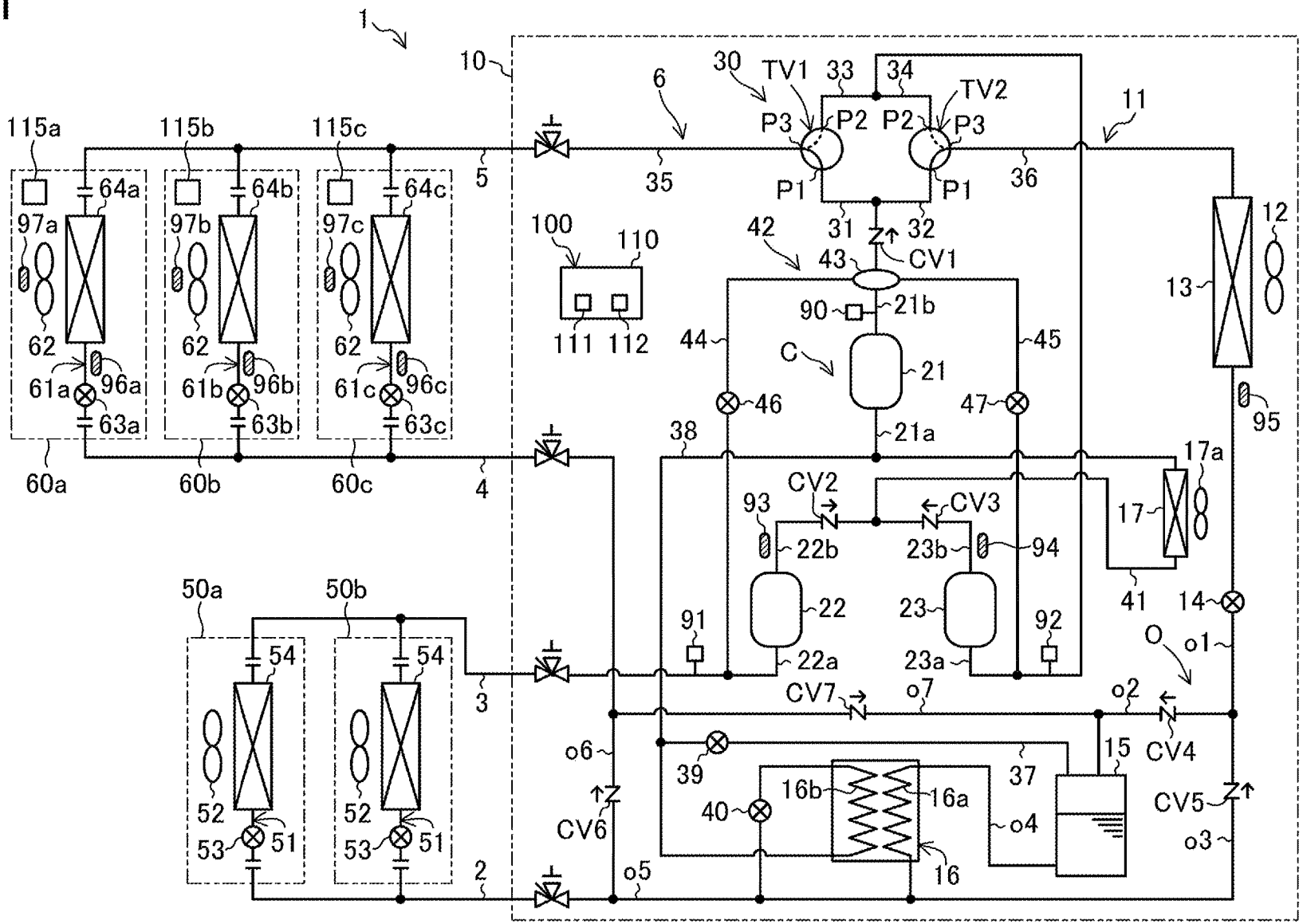
FIG. 1 is a piping system diagram of a refrigeration apparatus according to an embodiment.

As illustrated in FIG. 1, the refrigeration apparatus (1) includes an outdoor unit (10) placed outside, refrigeration-facility units (50*a*, 50*b*) that cool inside air, indoor units (60*a* to 60*c*) that perform air conditioning of an indoor space, and a controller (100). The refrigeration apparatus (1) of the present embodiment includes one outdoor unit (10), two refrigeration-facility units (50*a*, 50*b*), and three indoor units (60*a* to 60*c*). The numbers of the outdoor units (10), the refrigeration-facility units (50*a*, 50*b*), and the indoor units (60*a* to 60*c*) shown herein are mere examples.

In the refrigeration apparatus (1), the outdoor unit (10), the refrigeration-facility units (50*a*, 50*b*), and the indoor units (60*a* to 60*c*) are connected together via four connection pipes (2, 3, 4, 5) to constitutes a refrigerant circuit (6).

The four connection pipes (2, 3, 4, 5) consist of a first liquid connection pipe (2), a first gas connection pipe (3), a second liquid connection pipe (4), and a second gas connection pipe (5). The first liquid connection pipe (2) and the first gas connection pipe (3) are associated with the refrigeration-facility units (50*a*, 50*b*). The second liquid connection pipe (4) and the second gas connection pipe (5) are associated with the indoor units (60*a* to 60*c*). In the refrigerant circuit (6), the two refrigeration-facility units (50*a*, 50*b*) are connected in parallel, and the three indoor units (60*a* to 60*c*) are connected in parallel.

In the refrigerant circuit (6), a refrigerant circulates to perform a refrigeration cycle. The refrigerant in the refrigerant circuit (6) of the present embodiment is carbon dioxide. The refrigerant circuit (6) is configured to perform the refrigeration cycle so that the refrigerant has a pressure equal to or greater than a critical pressure.

—Outdoor Unit—

The outdoor unit (10) is a heat source unit placed outside. The outdoor unit (10) includes an outdoor fan (12) and an outdoor circuit (11). The outdoor circuit (11) includes a compression section (C), a switching unit (30), an outdoor heat exchanger (13), an outdoor expansion valve (14), a receiver (15), a subcooling heat exchanger (16), and an intercooler (17).

<Compression Section>

The compression section (C) compresses the refrigerant. The compression section (C) includes a first compressor (21), a second compressor (22), and a third compressor (23). The compression section (C) is of a two-stage compression type. The second compressor (22) and the third compressor (23) constitute a low-stage compressor. The second compressor (22) and the third compressor (23) are connected in parallel. The first compressor (21) constitutes a high-stage compressor. The first compressor (21) and the second compressor (22) are connected in series. The first compressor (21) and the third compressor (23) are connected in series.

The first compressor (21), the second compressor (22), and the third compressor (23) are each a hermetic compressor including a compression mechanism that is a fluid machinery and an electric motor that drives the compression mechanism. The compressors (21, 22, 23) each have a variable operating capacity. Specifically, alternating current is supplied from an inverter (not shown) to the electric motor of each compressor (21, 22, 23). The change in the frequency (operation frequency of the compressor) of the alternating current supplied from the inverter to each compressor (21, 22, 23) changes the rotational speed of the compression mechanism driven by the electric motor. This results in change of the operating capacity of each compressor (21, 22, 23). The change in the operating capacity of each compressor (21, 22, 23) changes the operating capacity of the compression section (C).

A first suction pipe (21*a*) and a first discharge pipe (21*b*) are connected to the first compressor (21). A second suction pipe (22*a*) and a second discharge pipe (22*b*) are connected to the second compressor (22). A third suction pipe (23*a*) and a third discharge pipe (23*b*) are connected to the third compressor (23).

The second suction pipe (22*a*) communicates with the refrigeration-facility units (50*a*, 50*b*). The second compressor (22) is a refrigeration-facility compressor associated with the refrigeration-facility units (50*a*, 50*b*). The third suction pipe (23*a*) communicates with the indoor units (60*a* to 60*c*). The third compressor (23) is an indoor-side compressor associated with the indoor units (60*a* to 60*c*).

<Switching Unit>

The switching unit (30) switches a refrigerant flow path in the refrigerant circuit (6). The switching unit (30) includes a first pipe (31), a second pipe (32), a third pipe (33), a fourth pipe (34), a first three-way valve (TV1), and a second three-way valve (TV2). The inflow end of the first pipe (31) and the inflow end of the second pipe (32) are connected to the first discharge pipe (21*b*). The first pipe (31) and the second pipe (32) are pipes on which discharge pressure of the compression section (C) acts. The outflow end of the third pipe (33) and the outflow end of the fourth pipe (34) are connected to the third suction pipe (23*a*) of the third compressor (23). The third pipe (33) and the fourth pipe (34) are pipes on which suction pressure of the compression section (C) acts.

The first three-way valve (TV1) has a first port (P1), a second port (P2), and a third port (P3). The first port (P1) of the first three-way valve (TV1) is connected to the outflow end of the first pipe (31) that is a high-pressure flow path. The second port (P2) of the first three-way valve (TV1) is connected to the inflow end of the third pipe (33) which is a low-pressure flow path. The third port (P3) of the first three-way valve (TV1) is connected to an indoor gas-side flow path (35).

The second three-way valve (TV2) has a first port (P1), a second port (P2), and a third port (P3). The first port (P1) of the second three-way valve (TV2) is connected to the outflow end of the second pipe (32) that is a high-pressure flow path. The second port (P2) of the second three-way valve (TV2) is connected to the inflow end of the fourth pipe (34) that is a low-pressure flow path. The third port (P3) of the second three-way valve (TV2) is connected to the outdoor gas-side flow path (36).

The first three-way valve (TV1) and the second three-way valve (TV2) are each an electric three-way valve. The three-way valves (TV1, TV2) are each switched between the first state (the state indicated by a solid line in FIG. 1) and the second state (the state indicated by a dashed line in FIG. 1). In the three-way valves (TV1, TV2) in the first state, the first port (P1) and the third port (P3) communicate with each other, and the second port (P2) is closed. In the three-way valves (TV1, TV2) in the second state, the second port (P2) and the third port (P3) communicate with each other, and the first port (P1) is closed.

<Outdoor Heat Exchanger>

The outdoor heat exchanger (13) is a heat-source-side heat exchanger. The outdoor heat exchanger (13) is a fin-and-tube air heat exchanger. The outdoor fan (12) is arranged near the outdoor heat exchanger (13). The outdoor fan (12) transfers outdoor air. The outdoor heat exchanger exchanges heat between a refrigerant flowing therethrough and outdoor air transferred from the outdoor fan (12).

The gas end of the outdoor heat exchanger (13) is connected to an outdoor gas-side flow path (36). The liquid end of the outdoor heat exchanger (13) is connected to an outdoor flow path (O).

<Outdoor Flow Path>

The outdoor flow path (O) includes a first outdoor pipe (o1), a second outdoor pipe (o2), a third outdoor pipe (o3), a fourth outdoor pipe (o4), a fifth outdoor pipe (o5), a sixth outdoor pipe (o6), and a seventh outdoor pipe (o7).

One end of the first outdoor pipe (o1) is connected to the liquid end of the outdoor heat exchanger (13). The other end of the first outdoor pipe (o1) is connected to one end of the second outdoor pipe (o2) and one end of the third outdoor pipe (o3). The other end of the second outdoor pipe (o2) is connected to the top of the receiver (15). One end of the fourth outdoor pipe (o4) is connected to the bottom of the receiver (15). The other end of the fourth outdoor pipe (o4) is connected to one end of the fifth outdoor pipe (o5) and the other end of the third outdoor pipe (o3). The other end of the fifth outdoor pipe (o5) is connected to the first liquid connection pipe (2). One end of the sixth outdoor pipe (o6) is connected to an intermediate portion of the fifth outdoor pipe (o5). The other end of the sixth outdoor pipe (o6) is connected to the second liquid connection pipe (4). One end of the seventh outdoor pipe (o7) is connected to an intermediate portion of the sixth outdoor pipe (o6). The other end of the seventh outdoor pipe (o7) is connected to an intermediate portion of the second outdoor pipe (o2).

<Outdoor Expansion Valve>

The outdoor expansion valve (14) is connected to the first outdoor pipe (o1). The outdoor expansion valve (14) is a heat-source-side expansion valve. The outdoor expansion valve (14) is an electronic expansion valve having a variable opening degree.

<Receiver>

The receiver (15) constitutes a container that stores the refrigerant. In the receiver (15), the refrigerant is separated into a gas refrigerant and a liquid refrigerant. The top of the receiver (15) is connected to the other end of the second outdoor pipe (o2) and one end of a venting pipe (37). The other end of the venting pipe (37) is connected to an intermediate portion of an injection pipe (38). The venting pipe (37) is connected to a venting valve (39). The venting valve (39) is an electronic expansion valve having a variable opening degree.

<Subcooling Heat Exchanger>

The subcooling heat exchanger (16) cools the refrigerant (mainly the liquid refrigerant) separated in the receiver (15). The subcooling heat exchanger (16) includes a first refrigerant flow path (16*a*) and a second refrigerant flow path (16*b*). The first refrigerant flow path (16*a*) is connected to an intermediate portion of the fourth outdoor pipe (o4). The second refrigerant flow path (16*b*) is connected to an intermediate portion of the injection pipe (38).

One end of the injection pipe (38) is connected to an intermediate portion of the fifth outdoor pipe (o5). The other end of the injection pipe (38) is connected to the first suction pipe (21*a*) of the first compressor (21). In other words, the other end of the injection pipe (38) is connected to a portion of the compression section (C) with an intermediate pressure. The injection pipe (38) is provided with a pressure-reducing valve (40) upstream of the second refrigerant flow path (16*b*). The pressure-reducing valve (40) is an expansion valve having a variable opening degree.

In the subcooling heat exchanger (16), heat is exchanged between the refrigerant flowing through the first refrigerant flow path (16*a*) and the refrigerant flowing through the second refrigerant flow path (16*b*). The refrigerant that has been decompressed at the pressure-reducing valve (40) flows through the second refrigerant flow path (16*b*). Thus, the refrigerant flowing through the first refrigerant flow path (16*a*) is cooled in the subcooling heat exchanger (16).

<Intercooler>

The intercooler (17) is connected to an intermediate flow path (41). One end of the intermediate flow path (41) is connected to the second discharge pipe (22*b*) of the second compressor (22) and the third discharge pipe (23*b*) of the third compressor (23). The other end of the intermediate flow path (41) is connected to the first suction pipe (21*a*) of the first compressor (21). In other words, the other end of the intermediate flow path (41) is connected to a portion of the compression section (C) with an intermediate pressure.

The intercooler (17) is a fin-and-tube air heat exchanger. A cooling fan (17*a*) is arranged near the intercooler (17). The intercooler (17) exchanges heat between the refrigerant flowing therethrough and the outdoor air transferred from the cooling fan (17*a*).

<Oil Separation Circuit>

The outdoor circuit (11) includes an oil separation circuit (42). The oil separation circuit (42) includes an oil separator (43), a first oil return pipe (44), and a second oil return pipe (45).

The oil separator (43) is connected to the first discharge pipe (21*b*) of the first compressor (21). The oil separator (43) separates oil from the refrigerant discharged from the compression section (C). The inflow end of the first oil return pipe (44) is connected to the oil separator (43). The outflow end of the first oil return pipe (44) is connected to the second suction pipe (22*a*) of the second compressor (22). The outflow end of the second oil return pipe (45) is connected to the third suction pipe (23*a*) of the third compressor (23). The first oil return pipe (44) is connected to a first oil level control valve (46). The second oil return pipe (45) is connected to a second oil level control valve (47).

Oil separated in the oil separator (43) returns to the second compressor (22) via the first oil return pipe (44). Oil separated in the oil separator (43) returns to the third compressor (23) via the second oil return pipe (45). The oil separated in the oil separator (43) may return directly to an oil sump inside casing of the second compressor (22). The oil separated in the oil separator (43) may return directly to an oil sump inside casing of the third compressor (23).

<Check Valve>

The outdoor circuit (11) has a first check valve (CV1), a second check valve (CV2), a third check valve (CV3), a fourth check valve (CV4), a fifth check valve (CV5), a sixth check valve (CV6), and a seventh check valve (CV7).

The first check valve (CV1) is connected to the first discharge pipe (21*b*). The second check valve (CV2) is connected to the second discharge pipe (22*b*). The third check valve (CV3) is connected to the third discharge pipe (23*b*). The fourth check valve (CV4) is connected to the second outdoor pipe (o2). The fifth check valve (CV5) is connected to the third outdoor pipe (o3). The sixth check valve (CV6) is connected to the sixth outdoor pipe (o6). The seventh check valve (CV7) is connected to the seventh outdoor pipe (o7). The check valves (CV1 to CV7) allow the refrigerant to flow in the directions indicated by the respective arrows shown in FIG. 1, and disallow the refrigerant to flow in the directions opposite thereto.

<Sensor>

The outdoor circuit (11) is provided with a discharge pressure sensor (90), a first suction pressure sensor (91), a second suction pressure sensor (92), a first discharge temperature sensor (93), a second discharge temperature sensor (94), and an outdoor refrigerant temperature sensor (95).

The discharge pressure sensor (90) is provided in the first discharge pipe (21*b*) of the first compressor (21), and measures a pressure of the refrigerant discharged from the first compressor (21). The first suction pressure sensor (91) is provided in the second suction pipe (22*a*) of the second compressor (22), and measures a pressure of the refrigerant sucked into the second compressor (22). The second suction pressure sensor (92) is provided in the third suction pipe (23*a*) of the third compressor (23), and measures a pressure of the refrigerant sucked into the third compressor (23).

The first discharge temperature sensor (93) is provided in the second discharge pipe (22*b*) of the second compressor (22), and measures a temperature of the refrigerant discharged from the second compressor (22). The second discharge temperature sensor (94) is provided in the third discharge pipe (23*b*) of the third compressor (23), and measures a temperature of the refrigerant discharged from the third compressor (23). The outdoor refrigerant temperature sensor (95) is provided at the liquid end of the outdoor heat exchanger (13) connected to the first outdoor pipe (o1), and measures a temperature of the refrigerant flowing out of the outdoor heat exchanger (13) functioning as a radiator.

—Refrigeration-Facility Unit—

The refrigeration-facility units (50*a*, 50*b*) are each a refrigeration showcase placed in a store such as a convenience store. Each refrigeration-facility unit (50*a*, 50*b*) has an internal fan (52) and a refrigeration-facility circuit (51). The liquid end of the refrigeration-facility circuit (51) is connected to the first liquid connection pipe (2). The gas end of the refrigeration-facility circuit (51) is connected to the first gas connection pipe (3).

The refrigeration-facility circuit (51) has a refrigeration-facility expansion valve (53) and a refrigeration-facility heat exchanger (54). The refrigeration-facility expansion valve (53) and the refrigeration-facility heat exchanger (54) are arranged in this order from the liquid end to the gas end of the refrigeration-facility circuit (51). The refrigeration-facility expansion valve (53) is a first utilization expansion valve. The refrigeration-facility expansion valve (53) is configured as an electronic expansion valve having a variable opening degree.

The refrigeration-facility heat exchanger (54) is a cooling heat exchanger. The refrigeration-facility heat exchanger (54) is a fin-and-tube air heat exchanger. The internal fan (52) is arranged near the refrigeration-facility heat exchanger (54). The internal fan (52) transfers inside air. The refrigeration-facility heat exchanger (54) exchanges heat between the refrigerant flowing therethrough and inside air transferred from the internal fan (52).

—Indoor Unit—

The indoor units (60*a* to 60*c*) are utilization-side units, and are placed in an indoor space. The indoor units (60*a* to 60*c*) perform air conditioning in an indoor space as a target space. The indoor units (60*a* to 60*c*) each have an indoor fan (62) and an indoor circuit (61*a* to 61*c*). The liquid end of the indoor circuit (61*a* to 61*c*) is connected to the second liquid connection pipe (4). The gas end of the indoor circuit (61*a* to 61*c*) is connected to the second gas connection pipe (5).

Each indoor circuit (61*a* to 61*c*) is an utilization-side circuit. The indoor circuit (61*a* to 61*c*) has a single indoor expansion valve (63*a* to 63*c*) and a single indoor heat exchanger (64*a* to 64*c*). The indoor expansion valve (63*a* to 63*c*) and the indoor heat exchanger (64*a* to 64*c*) are arranged in this order from the liquid end to the gas end of the indoor circuit (61*a* to 61*c*). The indoor expansion valve (63*a* to 63*c*) is a second utilization expansion valve. The indoor expansion valve (63*a* to 63*c*) is an electronic expansion valve having a variable opening degree.

The indoor heat exchanger (64*a* to 64*c*) is an utilization-side heat exchanger. The indoor heat exchanger (64*a* to 64*c*) is a fin-and-tube air heat exchanger. The indoor fan (62) is arranged near the indoor heat exchanger (64*a* to 64*c*). The indoor fan (62) transfers indoor air. The indoor heat exchanger (64*a* to 64*c*) exchanges heat between a refrigerant flowing therethrough and indoor air transferred from the indoor fan (62).

Each indoor circuit (61*a* to 61*c*) is provided with an indoor refrigerant temperature sensor (96*a* to 96*c*). In each indoor circuit (61*a* to 61*c*), the indoor refrigerant temperature sensor (96*a* to 96*c*) is provided in a pipe connecting between the indoor heat exchanger (64*a* to 64*c*) and the indoor expansion valve (63*a* to 63*c*). The indoor refrigerant temperature sensor (96*a* to 96*c*) measures a temperature of the refrigerant flowing out of the indoor heat exchanger (64*a* to 64*c*) functioning as a radiator.

Each indoor unit (60*a* to 60*c*) is provided with an indoor air temperature sensor (97*a* to 97*c*). The indoor air temperature sensor (97*a* to 97*c*) measures a temperature of the air sucked into the indoor units (60*a* to 60*c*) upstream of the indoor heat exchanger (64*a* to 64*c*). The measured value obtained from the indoor air temperature sensor (97*a* to 97*c*) is substantially equal to the temperature of the indoor space (specifically, the ambient temperature of the indoor space) where the indoor unit (60*a* to 60*c*) is placed.

—Controller—

The controller (100) includes an outdoor controller (110) and indoor controllers (115*a* to 115*c*). The outdoor controller (110) is provided in the outdoor unit (10). The indoor controllers (115*a* to 115*c*) are provided in the respective indoor units (60*a* to 60*c*) on a one-by-one basis. The controller (100) is provided with the same number (three in this embodiment) of the indoor controllers (115*a* to 115*c*) as the indoor units (60*a* to 60*c*). The outdoor controller (110) communicates with the indoor controllers (115*a* to 115*c*) via wires or wirelessly.

The outdoor controller (110) includes a central processing unit (CPU) (111) that performs arithmetic processing, and a memory (112) storing programs and data. Each controller performs a control operation of controlling an operation of equipment provided in the outdoor unit (10) in response to the execution of the programs recorded in the memory (112) by the CPU (111).

Although not shown, just like the outdoor controller (110), the indoor controllers (115*a* to 115*c*) each include a central processing unit (CPU) that performs arithmetic processing, and a memory storing programs and data Each indoor controller (115*a* to 115*c*) performs a control operation of controlling an operation of equipment provided in each indoor unit (60*a* to 60*c*) in response to execution of the programs recorded in the memory by the CPU. Specifically, the indoor controllers (115*a* to 115*c*) of the indoor units (60*a* to 60*c*) control operations of the respective indoor units (60*a* to 60*c*) including the indoor controllers (115*a* to 115*c*).

In the refrigeration apparatus (1) of the present embodiment, the controller (100) may be configured as a single control unit provided in the outdoor unit (10) or any one of the indoor units (60*a* to 60*c*).

—Operation of Refrigeration Apparatus—

The operation of the refrigeration apparatus (1) will be described below. The refrigeration apparatus (1) selectively performs a refrigeration-facility operation, a cooling operation, a cooling/refrigeration-facility operation, a heating operation, a heating/refrigeration-facility operation, a heating/refrigeration-facility heat recovery operation, and a heating/refrigeration-facility residual heat operation.

<Refrigeration-Facility Operation>

Figure 2:
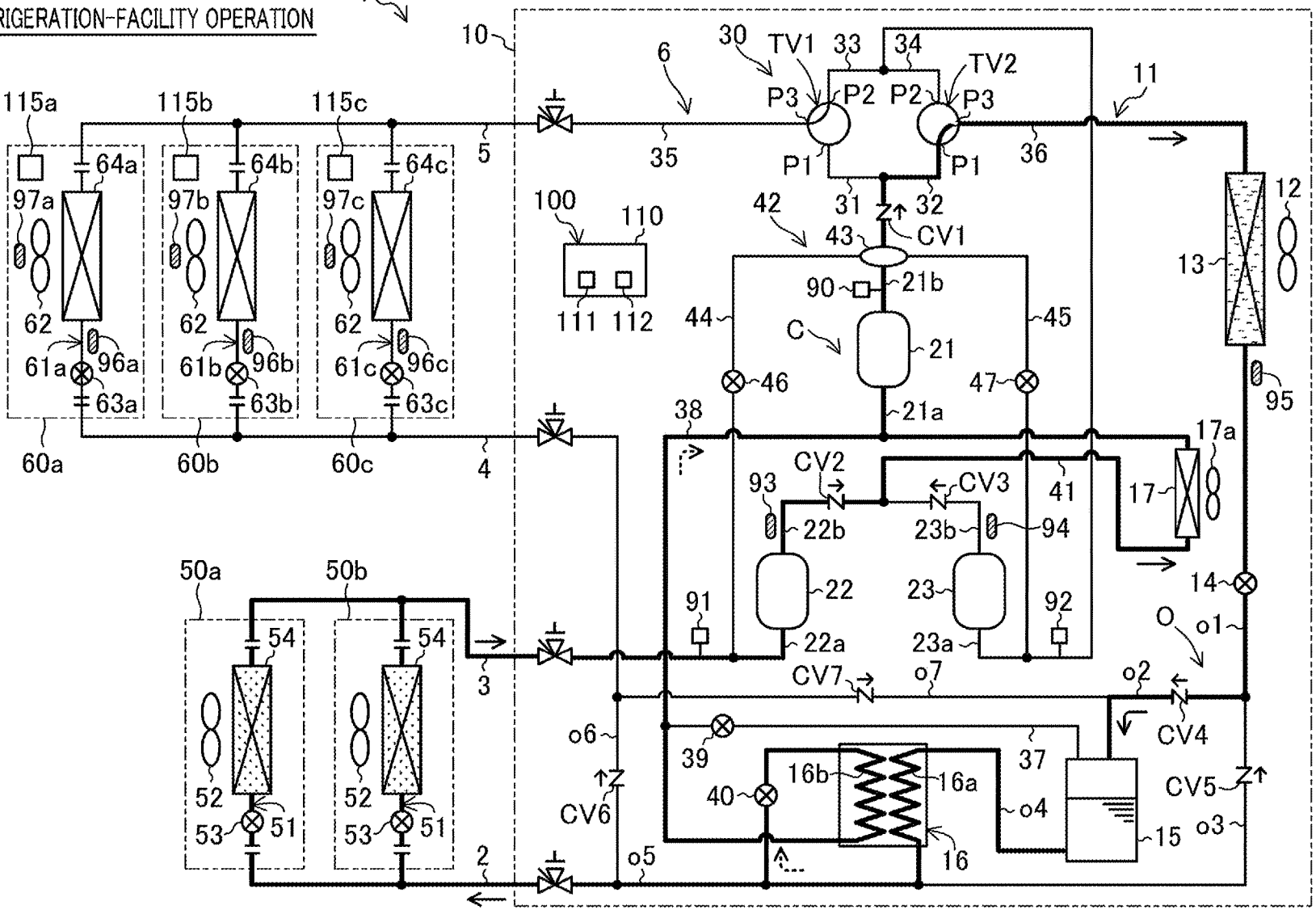
FIG. 2 corresponds to FIG. 1 and illustrates a flow of a refrigerant during a refrigeration-facility operation.

As illustrated in FIG. 2, in the refrigeration-facility operation, the refrigeration-facility units (50*a*, 50*b*) operate, and the indoor units (60*a* to 60*c*) are paused.

In the refrigeration-facility operation, the first three-way valve (TV1) is in the second state, and the second three-way valve (TV2) is in the first state. The outdoor expansion valve (14) is open at a predetermined opening degree, the opening degree of the refrigeration-facility expansion valve (53) is controlled by superheat control, the indoor expansion valves (63*a* to 63*c*) are fully closed, and the opening degree of the pressure-reducing valve (40) is controlled appropriately. The outdoor fan (12) and the internal fan (52) operate, and the indoor fan (62) is paused. The first compressor (21) and the second compressor (22) operate, and the third compressor (23) is paused.

In the refrigeration-facility operation, the refrigeration cycle is performed in the refrigerant circuit (6), the outdoor heat exchanger (13) functions as a radiator, and the refrigeration-facility heat exchanger (54) functions as an evaporator.

The refrigerant compressed by the second compressor (22) is cooled in the intercooler (17), and then sucked into the first compressor (21). The refrigerant compressed in the first compressor (21) dissipates heat in the outdoor heat exchanger (13), is decompressed through the outdoor expansion valve (14) into a gas-liquid two-phase state, and flows into the receiver (15). The refrigerant flowing out of the receiver (15) is cooled in the subcooling heat exchanger (16). The refrigerant that has been cooled in the subcooling heat exchanger (16) is decompressed in the refrigeration-facility expansion valve (53), and then evaporates in the refrigeration-facility heat exchanger (54). As a result, the inside air is cooled. The refrigerant that has evaporated in the subcooling heat exchanger (16) is sucked into the second compressor (22), and is then compressed again.

<Cooling Operation>

Figure 3:
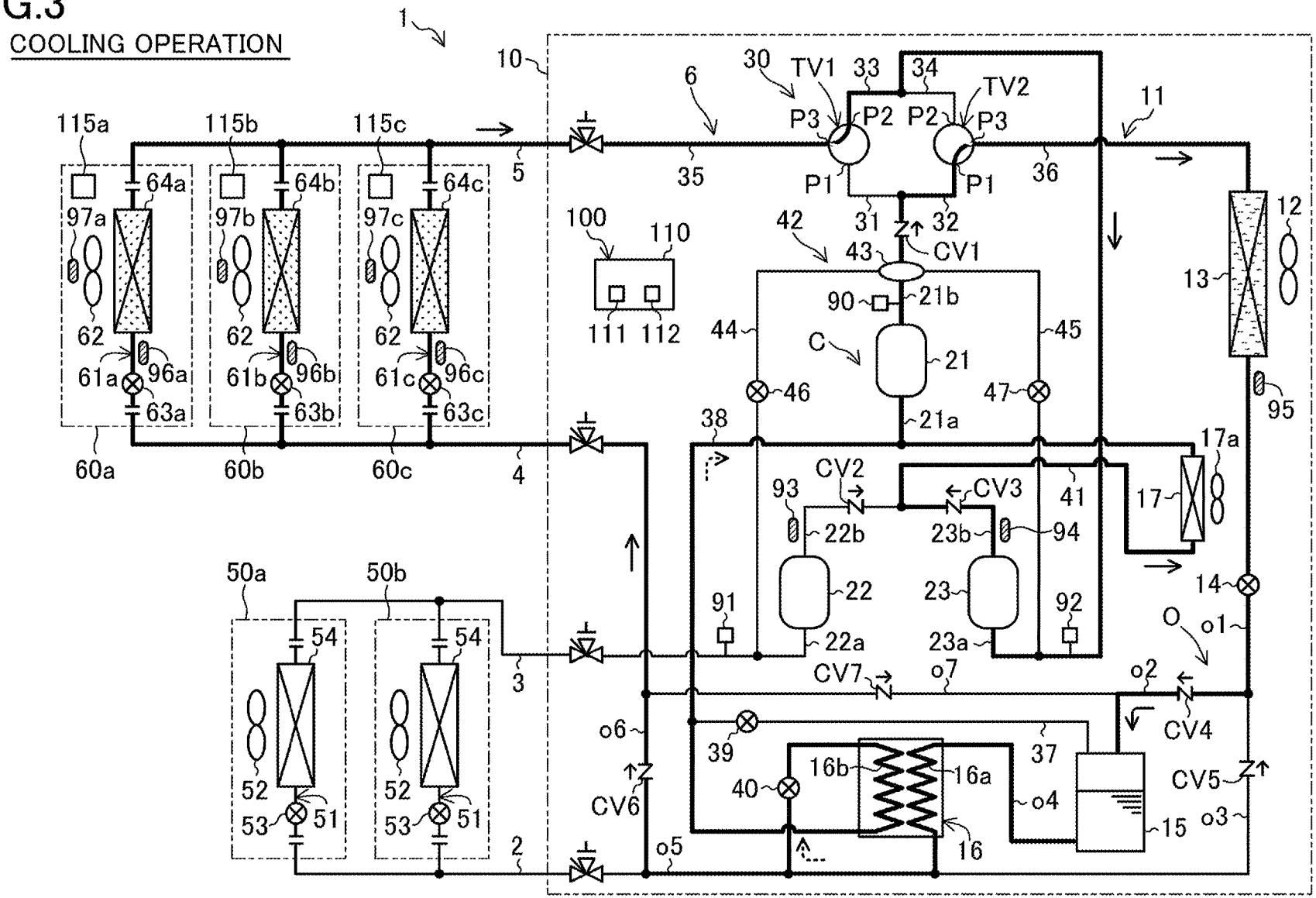
FIG. 3 corresponds to FIG. 1 and illustrates a flow of a refrigerant during the cooling operation.

As illustrated in FIG. 3, in the cooling operation, the refrigeration-facility units (50*a*, 50*b*) are paused, and the indoor units (60*a* to 60*c*) perform cooling.

In the cooling operation, the first three-way valve (TV1) is in the second state, and the second three-way valve (TV2) is in the first state. The outdoor expansion valve (14) is open at a predetermined opening degree, the refrigeration-facility expansion valve (53) is fully closed, the opening degrees of the indoor expansion valves (63*a* to 63*c*) are controlled by superheat control, and the opening degree of the pressure-reducing valve (40) is controlled appropriately. The outdoor fan (12) and the indoor fan (62) operate, and internal fan (52) is paused. The first compressor (21) and the third compressor (23) operate, and the second compressor (22) is paused.

In the cooling operation, the refrigeration cycle is performed in the refrigerant circuit (6), the outdoor heat exchanger (13) functions as a radiator, and the indoor heat exchangers (64*a* to 64*c*) each function as an evaporator.

The refrigerant compressed in the third compressor (23) is cooled in the intercooler (17), and is then sucked into the first compressor (21). The refrigerant compressed in the first compressor (21) dissipates heat in the outdoor heat exchanger (13), is decompressed through the outdoor expansion valve (14) into a gas-liquid two-phase state, and flows into the receiver (15). The refrigerant flowing out of the receiver (15) is cooled in the subcooling heat exchanger (16). The refrigerant that has been cooled in the subcooling heat exchanger (16) is decompressed in the indoor expansion valves (63*a* to 63*c*), and then evaporates in the indoor heat exchangers (64*a* to 64*c*). As a result, indoor air is cooled. The refrigerant that has evaporated in the indoor heat exchangers (64*a* to 64*c*) is sucked into the third compressor (23), and is then compressed again.

<Cooling/Refrigeration-Facility Operation>

Figure 4:
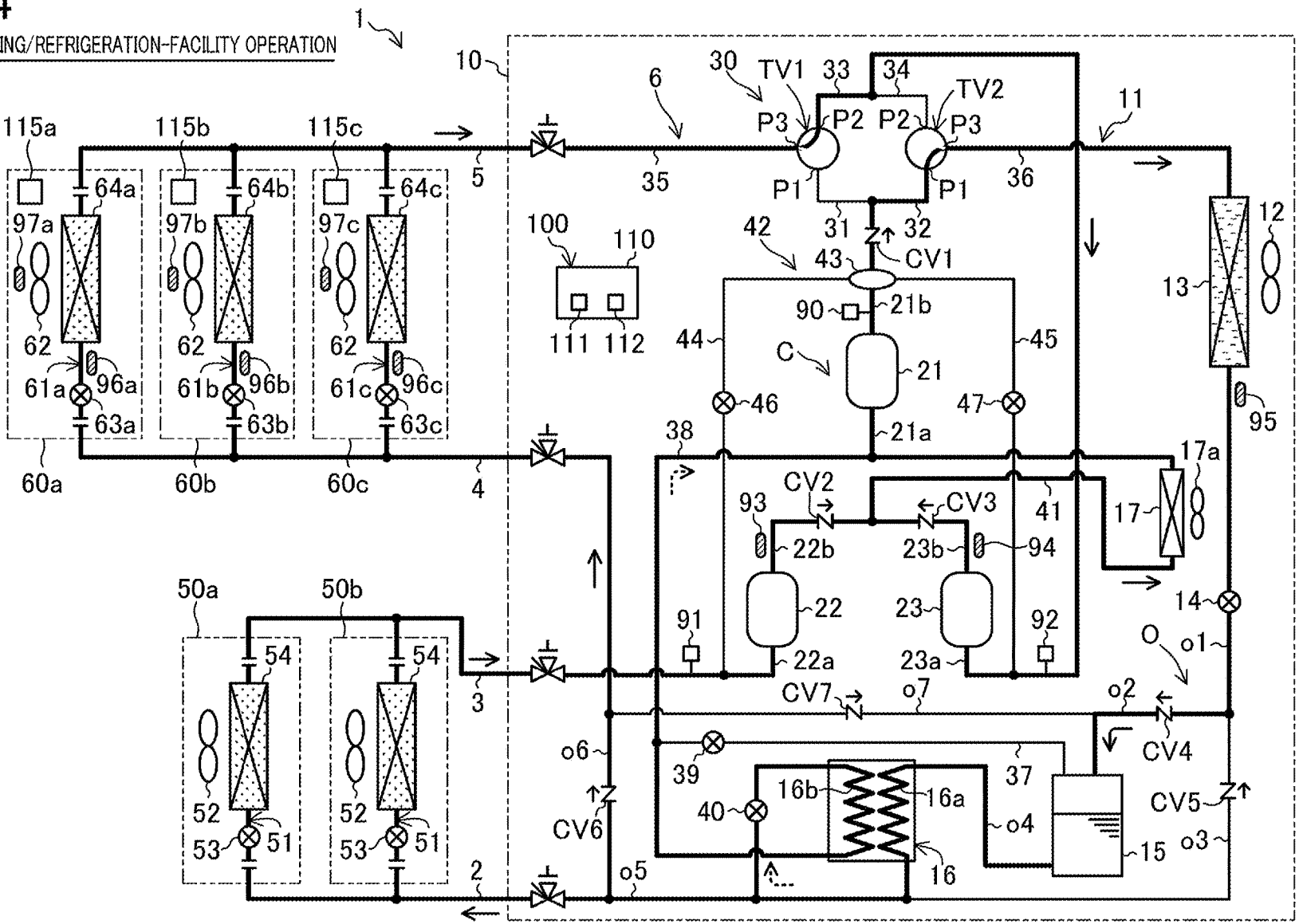
FIG. 4 corresponds to FIG. 1 and illustrates a flow of a refrigerant during a cooling/refrigeration-facility operation.

As illustrated in FIG. 4, in the cooling/refrigeration-facility operation, the refrigeration-facility units (50*a*, 50*b*) operate, and the indoor units (60*a* to 60*c*) perform cooling.

In the cooling/refrigeration-facility operation, the first three-way valve (TV1) is in the second state, and the second three-way valve (TV2) is in the first state. The outdoor expansion valve (14) is open at a predetermined opening degree, the opening degrees of the refrigeration-facility expansion valve (53) and the indoor expansion valves (63*a* to 63*c*) are controlled by superheat control, and the opening degree of the pressure-reducing valve (40) is controlled appropriately. The outdoor fan (12), the internal fan (52), and the indoor fan (62) operate. The first compressor (21), the second compressor (22), and the third compressor (23) operate.

In the cooling/refrigeration-facility operation, the refrigeration cycle is performed in the refrigerant circuit (6), the outdoor heat exchanger (13) functions as a radiator, and the refrigeration-facility heat exchanger (54) and the indoor heat exchangers (64*a* to 64*c*) each function as an evaporator.

The refrigerant compressed in the second compressor (22) and the refrigerant compressed in the third compressor (23) are cooled in the intercooler (17), and are then sucked into the first compressor (21). The refrigerant compressed in the first compressor (21) dissipates heat in the outdoor heat exchanger (13), is decompressed through the outdoor expansion valve (14) into a gas-liquid two-phase state, and flows into the receiver (15). The refrigerant flowing out of the receiver (15) is cooled in the subcooling heat exchanger (16). The refrigerant that has been cooled in the subcooling heat exchanger (16) diverges into the refrigeration-facility units (50*a*, 50*b*) and the indoor units (60*a* to 60*c*).

The refrigerant that has been decompressed in the refrigeration-facility expansion valve (53) evaporates in the refrigeration-facility heat exchanger (54). As a result, the inside air is cooled. The refrigerant that has evaporated in the refrigeration-facility heat exchanger (54) is sucked into the second compressor (22), and is then compressed again. The refrigerant that has been decompressed in the indoor expansion valves (63*a* to 63*c*) evaporates in the indoor heat exchangers (64*a* to 64*c*). As a result, indoor air is cooled. The refrigerant that has evaporated in the indoor heat exchangers (64*a* to 64*c*) is sucked into the third compressor (23), and is then compressed again.

<Heating Operation>

Figure 5:
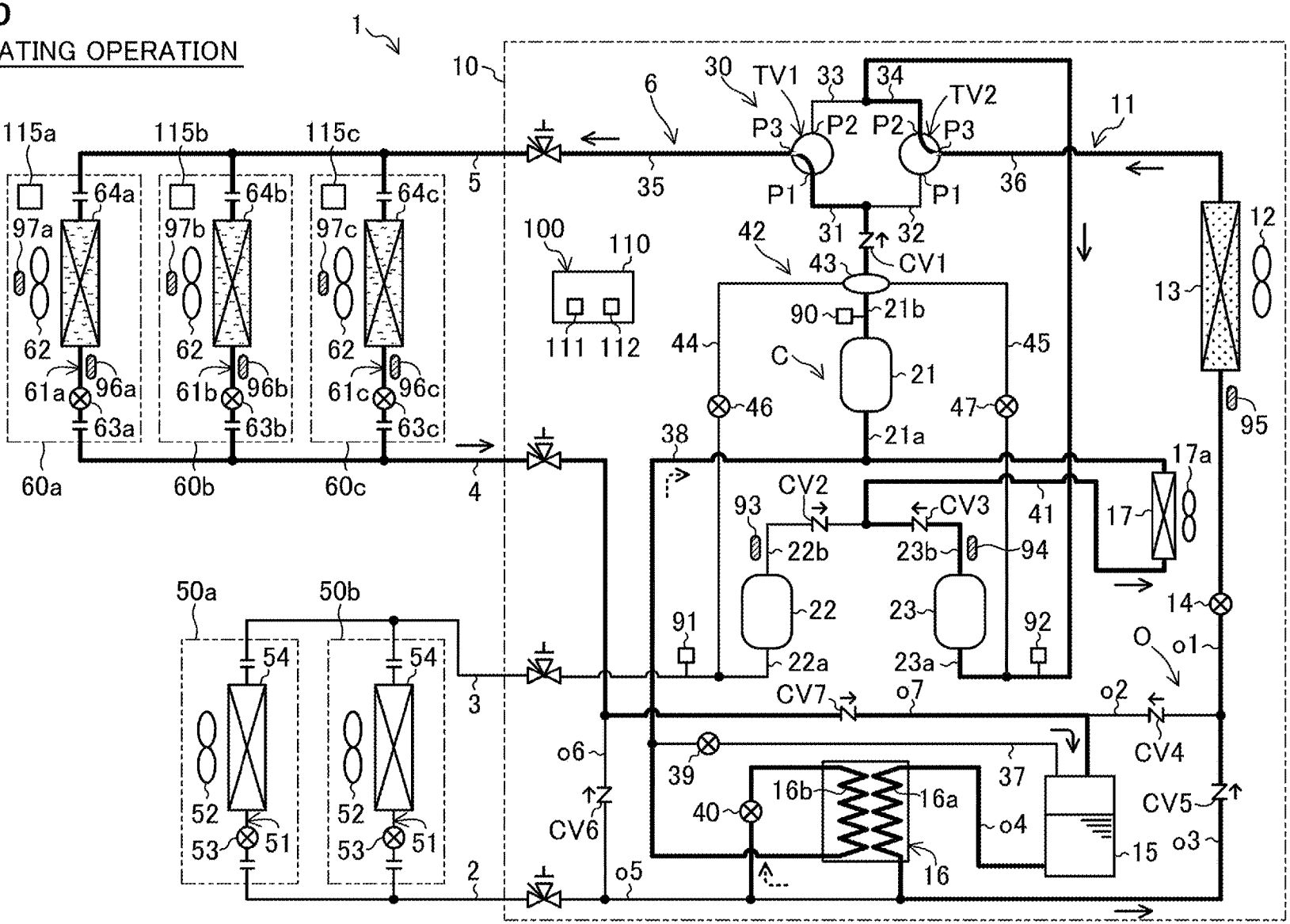
FIG. 5 corresponds to FIG. 1 and illustrates a flow of a refrigerant during a heating operation.

As illustrated in FIG. 5, in the heating operation, the refrigeration-facility units (50*a*, 50*b*) are paused, and the indoor units (60*a* to 60*c*) perform heating.

In the heating operation, the first three-way valve (TV1) is in the first state, and the second three-way valve (TV2) is in the second state. The opening degrees of the indoor expansion valves (63*a* to 63*c*) are controlled appropriately, the refrigeration-facility expansion valve (53) is fully closed, the opening degree of the outdoor expansion valve (14) is controlled by superheat control, and the opening degree of the pressure-reducing valve (40) is controlled appropriately. The outdoor fan (12) and the indoor fan (62) operate, and internal fan (52) is paused. The first compressor (21) and the third compressor (23) operate, and the second compressor (22) is paused.

In the heating operation, the refrigeration cycle is performed in the refrigerant circuit (6), the indoor heat exchangers (64*a* to 64*c*) each function as a radiator, and the outdoor heat exchanger (13) functions as an evaporator. This heating operation is a heat application operation.

The refrigerant that has been compressed in the third compressor (23) is sucked into the first compressor (21). The refrigerant that has been compressed in the first compressor (21) dissipates heat in the indoor heat exchangers (64*a* to 64*c*). As a result, indoor air is heated. The refrigerant that has dissipated heat in the indoor heat exchangers (64*a* to 64*c*) is decompressed through the indoor expansion valves (63*a* to 63*c*) into a gas-liquid two-phase state, and flows into the receiver (15). The refrigerant flowing out of the receiver (15) is cooled in the subcooling heat exchanger (16). The refrigerant that has been cooled in the subcooling heat exchanger (16) is decompressed in the outdoor expansion valve (14), and then evaporates in the outdoor heat exchanger (13). The refrigerant that has evaporated in the outdoor heat exchanger (13) is sucked into the third compressor (23), and is then compressed again.

<Heating/Refrigeration-Facility Operation>

Figure 6:
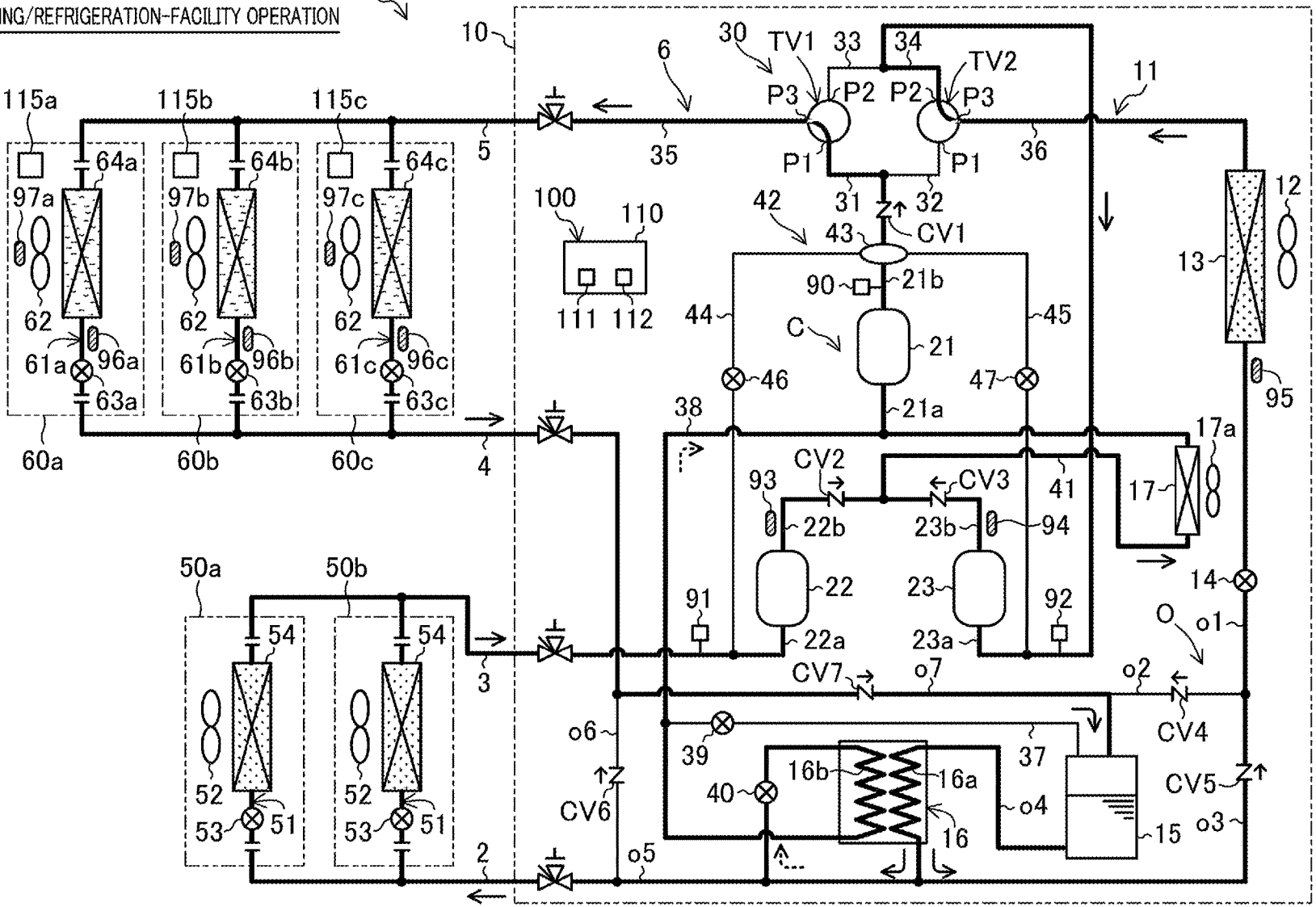
FIG. 6 corresponds to FIG. 1 and illustrates a flow of a refrigerant during a heating/refrigeration-facility operation.

As illustrated in FIG. 6, in the heating/refrigeration-facility operation, the refrigeration-facility units (50*a*, 50*b*) operate, and the indoor units (60*a* to 60*c*) perform heating.

In the heating/refrigeration-facility operation, the first three-way valve (TV1) is in the first state, and the second three-way valve (TV2) is in the second state. The opening degrees of the indoor expansion valves (63*a* to 63*c*) are controlled appropriately, the opening degrees of the refrigeration-facility expansion valve (53) and the outdoor expansion valve (14) are controlled by superheat control, and the opening degree of the pressure-reducing valve (40) is controlled appropriately. The outdoor fan (12), the internal fan (52), and the indoor fan (62) operate. The first compressor (21), the second compressor (22), and the third compressor (23) operate.

In the heating/refrigeration-facility operation, the refrigeration cycle is performed in the refrigerant circuit (6), the indoor heat exchangers (64*a* to 64*c*) each function as a radiator, and the refrigeration-facility heat exchanger (54) and the outdoor heat exchanger (13) each function as an evaporator. This heating/refrigeration-facility operation is a heat application operation.

The refrigerant that has been compressed in the second compressor (22) and the refrigerant that has been compressed in the third compressor (23) are sucked into the first compressor (21). The refrigerant that has been compressed in the first compressor (21) dissipates heat in the indoor heat exchangers (64*a* to 64*c*). As a result, indoor air is heated. The refrigerant that has dissipated heat in the indoor heat exchangers (64*a* to 64*c*) is decompressed through the indoor expansion valves (63*a* to 63*c*) into a gas-liquid two-phase state, and flows into the receiver (15). The refrigerant flowing out of the receiver (15) is cooled in the subcooling heat exchanger (16).

Part of the refrigerant that has been cooled in the subcooling heat exchanger (16) is decompressed in the outdoor expansion valve (14), and then evaporates in the outdoor heat exchanger (13). The refrigerant that has evaporated in the outdoor heat exchanger (13) is sucked into the third compressor (23), and is then compressed again. The remaining refrigerant that has been cooled in the subcooling heat exchanger (16) is decompressed in the refrigeration-facility expansion valve (53), and then evaporates in the refrigeration-facility heat exchanger (54). As a result, the inside air is cooled. The refrigerant that has evaporated in the refrigeration-facility heat exchanger (54) is sucked into the second compressor (22), and is then compressed again.

<Heating/Refrigeration-Facility Heat Recovery Operation>

Figure 7:
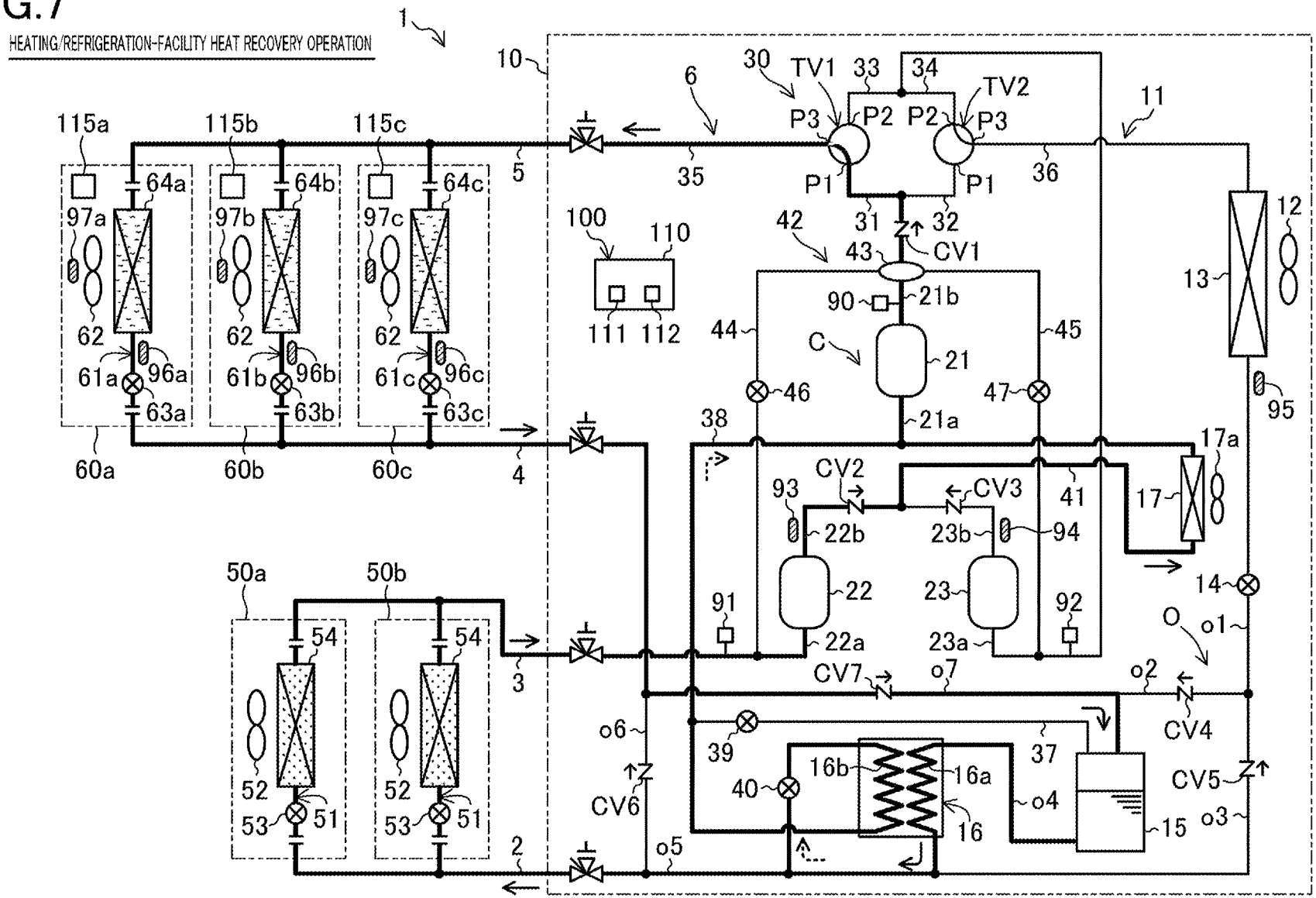
FIG. 7 corresponds to FIG. 1 and illustrates a flow of a refrigerant during a heating/refrigeration-facility heat recovery operation.

As illustrated in FIG. 7, in the heating/refrigeration-facility heat recovery operation, the refrigeration-facility units (50*a*, 50*b*) operate, and the indoor units (60*a* to 60*c*) perform heating.

In the heating/refrigeration-facility heat recovery operation, the first three-way valve (TV1) is in the first state, and the second three-way valve (TV2) is in the second state. The opening degrees of the indoor expansion valves (63*a* to 63*c*) are controlled appropriately, the outdoor expansion valve (14) is fully closed, the opening degree of the refrigeration-facility expansion valve (53) is controlled by superheat control, and the opening degree of the pressure-reducing valve (40) is controlled appropriately. The indoor fan (62) and the internal fan (52) are operated, and the outdoor fan (12) is paused. The first compressor (21) and the second compressor (22) are operated, and the third compressor (23) is paused.

In the heating/refrigeration-facility heat recovery operation, the refrigeration cycle is performed in the refrigerant circuit (6), the indoor heat exchangers (64*a* to 64*c*) each function as a radiator, and the refrigeration-facility heat exchanger (54) functions as an evaporator. In the heating/refrigeration-facility heat recovery operation, the outdoor heat exchanger (13) is paused substantially. This heating/refrigeration-facility heat recovery operation is a heat application operation.

The refrigerant that has been compressed in the second compressor (22) is sucked into the first compressor (21). The refrigerant that has been compressed in the first compressor (21) dissipates heat in the indoor heat exchangers (64*a* to 64*c*). As a result, indoor air is heated. The refrigerant that has dissipated heat in the indoor heat exchangers (64*a* to 64*c*) is decompressed through the indoor expansion valves (63*a* to 63*c*) into a gas-liquid two-phase state, and flows into the receiver (15). The refrigerant flowing out of the receiver (15) is cooled in the subcooling heat exchanger (16). The refrigerant that has been cooled in the subcooling heat exchanger (16) is decompressed in the refrigeration-facility expansion valve (53), and then evaporates in the refrigeration-facility heat exchanger (54). As a result, the inside air is cooled. The refrigerant that has evaporated in the refrigeration-facility heat exchanger (54) is sucked into the second compressor (22), and is then compressed again.

<Heating/Refrigeration-Facility Residual Heat Operation>

Figure 8:
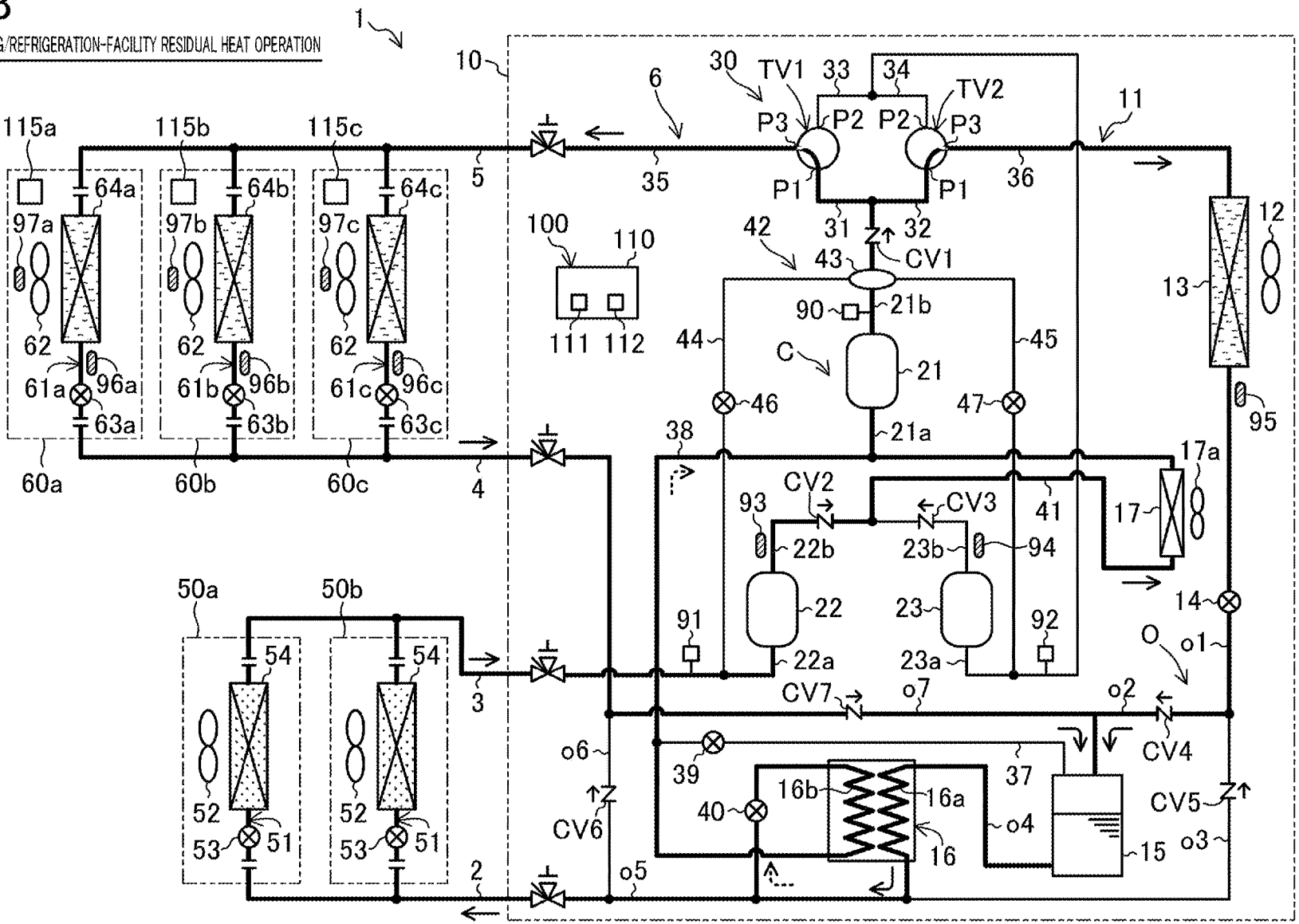
FIG. 8 corresponds to FIG. 1 and illustrates a flow of a refrigerant during a heating/refrigeration-facility residual heat operation.

As illustrated in FIG. 8, in the heating/refrigeration-facility residual heat operation, the refrigeration-facility units (50*a*, 50*b*) operate, and the indoor units (60*a* to 60*c*) perform heating.

In the heating/refrigeration-facility residual heat operation, the first three-way valve (TV1) is in the first state, and the second three-way valve (TV2) is in the first state. The opening degrees of the indoor expansion valves (63*a* to 63*c*) and the outdoor expansion valve (14) are controlled appropriately, the opening degree of the refrigeration-facility expansion valve (53) is controlled by superheat control, and the opening degree of the pressure-reducing valve (40) is controlled appropriately. The outdoor fan (12), the internal fan (52), and the indoor fan (62) operate. The first compressor (21) and the second compressor (22) operate, and the third compressor (23) is paused.

In the heating/refrigeration-facility residual heat operation, the refrigeration cycle is performed in the refrigerant circuit (6), the indoor heat exchangers (64*a* to 64*c*) and the outdoor heat exchanger (13) each function as a radiator, and the refrigeration-facility heat exchanger (54) functions as an evaporator. This heating/refrigeration-facility residual heat operation is a heat application operation.

The refrigerant that has been compressed in the second compressor (22) is sucked into the first compressor (21). Part of the refrigerant that has been compressed in the first compressor (21) dissipates heat in the outdoor heat exchanger (13). The remaining refrigerant that has been compressed in the first compressor (21) dissipates heat in the indoor heat exchangers (64*a* to 64*c*). As a result, indoor air is heated. The refrigerant that has dissipated heat in the outdoor heat exchanger (13) is decompressed when passing through the expansion valve (14), into a gas-liquid two-phase state. The refrigerant that has dissipated heat in the indoor heat exchangers (64*a* to 64*c*) is decompressed when passing through the indoor expansion valves (63*a* to 63*c*), into a two-phase gas-liquid state. The refrigerant that has passed through the outdoor expansion valve (14) and the refrigerant that has passed through the indoor expansion valves (63*a* to 63*c*) merge together, and then flow into the receiver (15). The refrigerant flowing out of the receiver (15) is cooled in the subcooling heat exchanger (16). The refrigerant that has been cooled in the subcooling heat exchanger (16) is decompressed in the refrigeration-facility expansion valve (53), and then evaporates in the refrigeration-facility heat exchanger (54). As a result, the inside air is cooled. The refrigerant that has evaporated in the refrigeration-facility heat exchanger (54) is sucked into the second compressor (22), and is then compressed again.

—Control Operation of Controller—

Control operation performed by the controller (100) will be described. The control operation performed by the controller (100) in the heating operation, heating/refrigeration-facility operation, heating/refrigeration-facility heat recovery operation, and heating/refrigeration-facility residual heat operation, which are heat application operations, will be described below.

In each of the heating operation, heating/refrigeration-facility operation, heating/refrigeration-facility heat recovery operation, and heating/refrigeration-facility residual heat operation, the high pressure of the refrigeration cycle (specifically, the pressure of the refrigerant discharged from the compression section (C)) becomes equal to or greater than the critical pressure of the refrigerant (carbon dioxide in the present embodiment). In these operations, the indoor heat exchangers (64*a* to 64*c*) each function as a radiator (gas cooler).

<Control Operation (1) of Indoor Controller>

A user inputs set temperatures to the indoor controllers (115*a* to 115*c*) of the indoor units (60*a* to 60*c*) The indoor controllers (115*a* to 115*c*) store the set temperatures in their memories. The set temperatures may be separately set for each indoor unit (60*a* to 60*c*). The set temperatures stored in the indoor controllers (115*a* to 115*c*) may thus be the same as or different from each other.

In each indoor unit (60*a* to 60*c*), the indoor controller (115*a* to 115*c*) controls an operation of the indoor unit (60*a* to 60*c*) based on the set temperature stored in the memory and a measured value obtained from the indoor air temperature sensor (97*a* to 97*c*). Specifically, the first indoor controller (115*a*) controls the first indoor unit (60*a*) based on the set temperature and the measured value obtained from the first indoor air temperature sensor (97*a*). The second indoor controller (115*b*) controls a second indoor unit (60*b*) based on the set temperature and the measured value obtained from the second indoor air temperature sensor (97*b*). The third indoor controller (115*c*) controls a third indoor unit (60*c*) based on the set temperature and the measured value obtained from the third indoor air temperature sensor (97*c*).

Each indoor controller (115*a* to 115*c*) controls the indoor unit (60*a* to 60*c*) such that the measured value obtained from the indoor air temperature sensor (97*a* to 97*c*) reaches the set temperature. Specifically, the indoor controller (115*a* to 115*c*) causes the indoor unit (60*a* to 60*c*) to operate such that the measured value obtained from the indoor air temperature sensor (97*a* to 97*c*) falls within "a first temperature range including the set temperature (e.g., the range of the set temperatures ±1° C.)."

When the measured value obtained from the indoor air temperature sensor (97*a* to 97*c*) exceeds the upper limit of the first temperature range (e.g., the set temperature +1° C.) during heating by the indoor unit (60*a* to 60*c*), the indoor controller (115*a* to 115*c*) fully opens the indoor expansion valve (63*a* to 63*c*), and application of heat to air in indoor heat exchanger (64*a* to 64*c*) is paused. In the indoor unit (60*a* to 60*c*) in this state, the indoor fan (62) continuously operates. When the measured value obtained from the indoor air temperature sensor (97*a* to 97*c*) falls lower than the lower limit of the first temperature range (e.g., the set temperature −1° C.) during pausing of the application of heat to air in the indoor heat exchanger (64*a* to 64*c*), the indoor controller (115*a* to 115*c*) opens the indoor expansion valve (63*a* to 63*c*), and restarts the application of heat to air in the indoor heat exchangers (64*a* to 64*c*).

When the measured value obtained from the indoor air temperature sensor (97*a* to 97*c*) exceeds the upper limit of the first temperature range during heating by the indoor unit (60*a* to 60*c*), the indoor controller (115*a* to 115*c*) may not fully open the indoor expansion valve (63*a* to 63*c*) and may hold the opening degree of the indoor expansion valve (63*a* to 63*c*) to be a first opening degree which is a slight opening degree. In this case, when the measured value obtained from the indoor air temperature sensor (97*a* to 97*c*) falls lower than the lower limit of the first temperature range during pausing of the application of heat to air in the indoor heat exchanger (64*a* to 64*c*), the indoor controller (115*a* to 115*c*) increases the opening degree of the indoor expansion valves (63*a* to 63*c*) to be larger than the first opening degree, and restarts the application of heat to air in the indoor heat exchangers (64*a* to 64*c*).

<Control Operation (2) of Indoor Controller>

The indoor controller (115*a* to 115*c*) of each indoor unit (60*a* to 60*c*) stores, in its memory, a reference temperature transmitted from the outdoor controller (110). Operation of the outdoor controller (110) to determine the reference temperature will be described later.

In the indoor unit (60*a* to 60*c*), the indoor controller (115*a* to 115*c*) controls the opening degree of the indoor expansion valve (63*a* to 63*c*) based on the reference temperature stored in the memory and a measured value obtained from the indoor refrigerant temperature sensor (96*a* to 96*c*). Specifically, the first indoor controller (115*a*) controls the opening degree of the first indoor expansion valve (63*a*) based on the reference temperature and the measured value obtained from the first indoor refrigerant temperature sensor (96*a*). The second indoor controller (115*b*) controls the opening degree of the second indoor expansion valve (63*b*) based on the reference temperature and the measured value obtained from the second indoor refrigerant temperature sensor (96*b*). The third indoor controller (115*c*) controls the opening degree of the third indoor expansion valve (63*c*) based on the reference temperature and the measured value obtained from the third indoor refrigerant temperature sensor (96*c*).

The indoor controller (115*a* to 115*c*) controls the opening degree of the indoor expansion valve (63*a* to 63*c*) such that the measured value obtained from the indoor refrigerant temperature sensor (96*a* to 96*c*) reaches the reference temperature.

Specifically, when the measured value obtained from the indoor refrigerant temperature sensor (96*a* to 96*c*) exceeds the reference temperature during heating by the indoor unit (60*a* to 60*c*), the indoor controller (115*a* to 115*c*) decreases the opening degree of the indoor expansion valve (63*a* to 63*c*) to decrease the flow rate of the refrigerant flowing through the indoor heat exchanger (64*a* to 64*c*). The decrease in the flow rate of the refrigerant flowing through the indoor heat exchanger (64*a* to 64*c*) decreases the temperature of the refrigerant flowing out of the indoor heat exchanger (64*a* to 64*c*).

When the measured value obtained from the indoor refrigerant temperature sensor (96*a* to 96*c*) falls below the reference temperature during heating by the indoor unit (60*a* to 60*c*), the indoor controller (115*a* to 115*c*) increases the opening degree of the indoor expansion valve (63*a* to 63*c*) to increase the flow rate of the refrigerant flowing through the indoor heat exchanger (64*a* to 64*c*). The increase in the flow rate of the refrigerant flowing through the indoor heat exchanger (64*a* to 64*c*) increases the temperature of the refrigerant flowing out of the indoor heat exchanger (64*a* to 64*c*).

<Control Operation (1) of Outdoor Controller>

The outdoor controller (110) receives a set temperature transmitted from the indoor controller (115*a* to 115*c*) of each indoor unit (60*a* to 60*c*) and stores the set temperature in the memory (112). The outdoor controller (110) determines the reference temperature based on the set temperature for the indoor unit (60*a* to 60*c*) recorded in the memory (112).

Specifically, the outdoor controller (110) selects the highest set temperature among the set temperatures for the indoor units (60*a* to 60*c*) recorded in the memory (112), and determines, as the respective reference temperatures, temperatures higher than the highest set temperature (e.g., the highest temperature +5° C.). The outdoor controller (110) transmits the reference temperatures determined, to the indoor controllers (115*a* to 115*c*). The reference temperatures transmitted from the outdoor controller (110) to the indoor controllers (115*a* to 115*c*) are all the same.

<Control Operation (2) of Outdoor Controller>

The outdoor controller (110) determines a heat-source-side reference temperature and stores the heat-source-side reference temperature in the memory (112). The outdoor controller (110) of the present embodiment determines, as the heat-source-side reference temperature, the same value as the reference temperature determined based on the set temperatures for the indoor units (60*a* to 60*c*). The outdoor controller (110) may determine a value different from the reference temperature as the heat-source-side reference temperature.

In the heating/refrigeration-facility residual heat operation in which the outdoor heat exchanger (13) functions as a radiator (gas cooler), the outdoor controller (110) controls the opening degree of the outdoor expansion valve (14) based on the heat-source-side reference temperature stored in the memory (112) and the measured value obtained from the outdoor refrigerant temperature sensor (95).

The outdoor controller (110) controls the opening degree of the outdoor expansion valve (14) so that the measured value obtained from the outdoor refrigerant temperature sensor (95) reaches the heat-source-side reference temperature.

Specifically, when the measured value obtained from the outdoor refrigerant temperature sensor (95) exceeds the heat-source-side reference temperature, the outdoor controller (110) decreases the opening degree of the outdoor expansion valve (14), and decreases the flow rate of the refrigerant flowing through the outdoor heat exchanger (13). The decrease in the flow rate of the refrigerant flowing through the outdoor heat exchanger (13) causes a decrease in the temperature of the refrigerant flowing out of the outdoor heat exchanger (13).

When the measured value obtained from the outdoor refrigerant temperature sensor (95) falls below the heat-source-side reference temperature during the heating/refrigeration-facility residual heat operation, the outdoor controller (110) increases the opening degree of the outdoor expansion valve (14) to increase the flow rate of the refrigerant flowing through the outdoor heat exchanger (13). The increase in the flow rate of the refrigerant flowing through the outdoor heat exchanger (13) causes an increase in the temperature of the refrigerant flowing out of the outdoor heat exchanger (13).

<Control Operation (3) of Outdoor Controller>

In the heating operation and heating/refrigeration-facility operation in which the outdoor heat exchanger (13) functions as an evaporator, the outdoor controller (110) controls operation of the compression section (C) based on the reference high pressure recorded in the memory (112) and the measured value obtained from the discharge pressure sensor (90).

The outdoor controller (110) controls operation of the compression section (C) so that the measured value obtained from the discharge pressure sensor (90) reaches the reference high pressure. Specifically, the outdoor controller (110) controls the operating capacity of the third compressor (23) so that the measured value obtained from the discharge pressure sensor (90) falls within "a high-pressure range including the reference high pressure (e.g., a range of the reference high pressure±300 kPa)."

When the measured value obtained from the discharge pressure sensor (90) exceeds the upper limit of the high-pressure range (e.g., the reference high pressure+300 kPa), the outdoor controller (110) decreases the operation frequency of the third compressor (23) to decrease the operating capacity of the third compressor (23). The decrease in the operating capacity of the third compressor (23) causes a decrease in the pressure of the refrigerant sucked into the first compressor (21). As a result, the pressure of the refrigerant discharged from the first compressor (21) decreases.

When the measured value obtained from the discharge pressure sensor (90) falls below the lower limit of the high-pressure range (e.g., the reference high pressure −300 kPa), the outdoor controller (110) increases the operation frequency of the third compressor (23) to increase the operating capacity of the third compressor (23). The increase in the operating capacity of the third compressor (23) causes an increase in the pressure of the refrigerant sucked into the first compressor (21). As a result, the pressure of the refrigerant discharged from the first compressor (21) increases.

<Control Operation (4) of Outdoor Controller>

In the heating/refrigeration-facility residual heat operation in which the outdoor heat exchanger (13) functions as a radiator (gas cooler), the outdoor controller (110) controls operation of the outdoor fan (12) based on the reference high pressure recorded in the memory (112) and the measured value obtained from the discharge pressure sensor (90).

The outdoor controller (110) controls operation of the outdoor fan (12) so that the measured value obtained from the discharge pressure sensor (90) reaches the reference high pressure. Specifically, the outdoor controller (110) controls the amount of airflow from the outdoor fan (12) so that the measured value obtained from the discharge pressure sensor (90) falls within the "high-pressure range including the reference high pressure (e.g., the range of the reference high pressure±300 kPa)."

When the measured value obtained from the discharge pressure sensor (90) exceeds the upper limit of the high-pressure range (e.g., the reference high pressure+300 kPa), the outdoor controller (110) increases the rotational speed of the outdoor fan (12) to increase the amount of airflow from the outdoor fan (12). The increase in the amount of airflow from the outdoor fan (12) causes an increase in the amount of heat dissipated from the refrigerant in the outdoor heat exchanger (13). As a result, the pressure of the refrigerant discharged from the first compressor (21) (i.e., the high pressure of the refrigeration cycle) decreases.

When the measured value obtained from the discharge pressure sensor (90) falls below the lower limit of the high-pressure range (e.g., the reference high pressure −300 kPa), the outdoor controller (110) decreases the rotational speed of the outdoor fan (12) to decrease the amount of airflow from the outdoor fan (12). The decrease in the amount of airflow from the outdoor fan (12) causes a decrease in the amount of heat dissipated from the refrigerant in the outdoor heat exchanger (13). As a result, the pressure of the refrigerant discharged from the first compressor (21) (i.e., the high pressure of the refrigeration cycle) increases.

<Control Operation (5) of Outdoor Controller>

Figure 9:
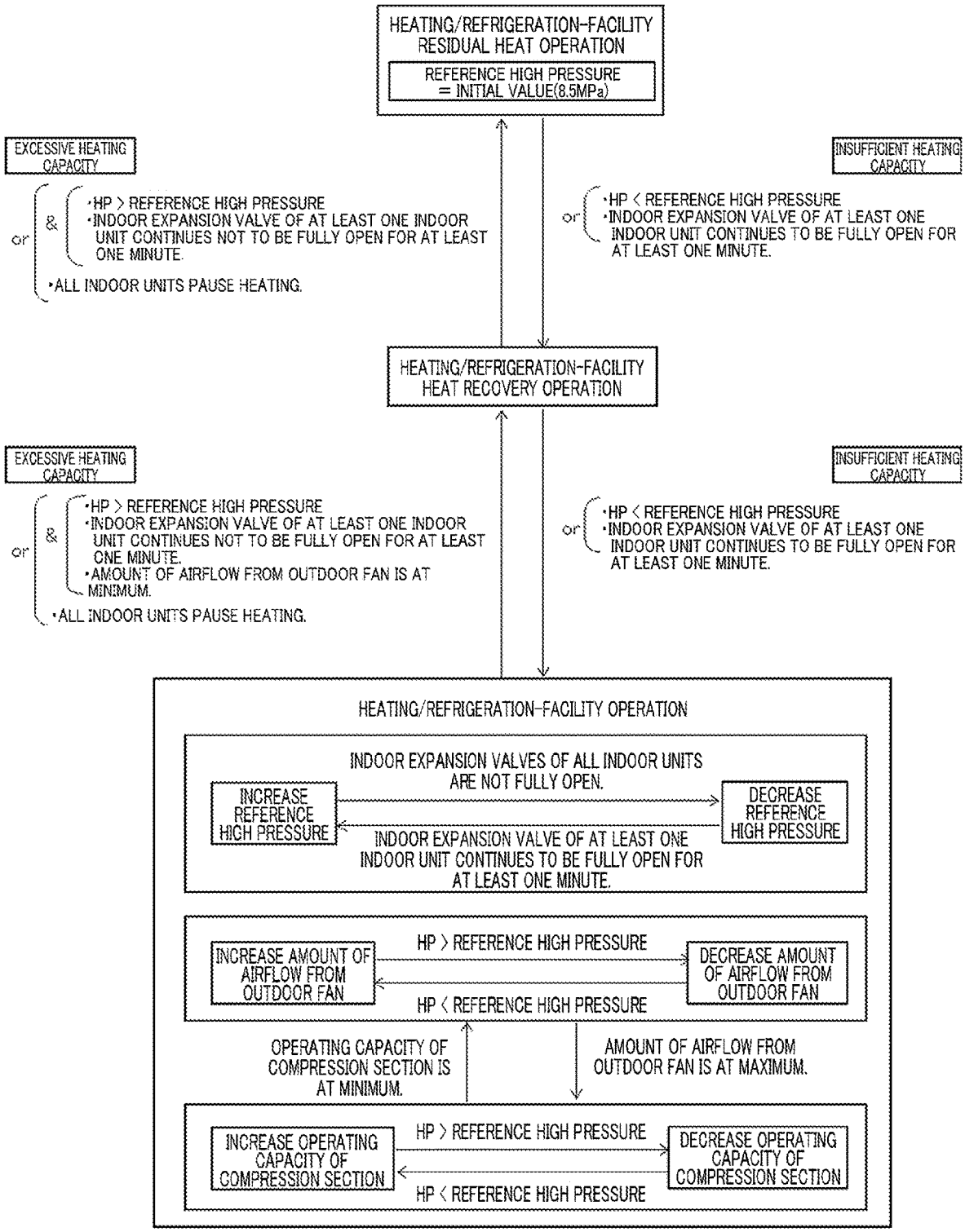
FIG. 9 is a state transition diagram showing a control operation performed by a controller.

As illustrated in FIG. 9, in the heat application operation (specifically the heating operation and the heating/refrigeration-facility operation) where the outdoor heat exchanger (13) functions as an evaporator, the outdoor controller (110) controls the reference high pressure.

The indoor controller (115*a* to 115*c*) of each indoor unit (60*a* to 60*c*) outputs a fully opening signal indicating that the indoor expansion valve (63*a* to 63*c*) is fully open when the opening degree of the indoor expansion valve (63*a* to 63*c*) of the indoor unit (60*a* to 60*c*) is at maximum. The outdoor controller (110) controls the reference high pressure based on the fully opening signal received from the indoor controller (115*a* to 115*c*).

The maximum opening degree of each indoor expansion valve (63*a* to 63*c*) may not be its maximum structural opening degree. For example, the extent of controlling the opening degree of the indoor expansion valve (63*a* to 63*c*) may differ between the cooling operation and the heating operation. In such a case, the upper limit of the extent of controlling the opening degree may be smaller than the maximum structural opening degree. In the present embodiment, the maximum opening degree of the indoor expansion valve (63*a* to 63*c*) means the upper limit of the opening degree of its extent of controlling the opening degree. When the opening degree of the indoor expansion valve (63*a* to 63*c*) is the upper limit of the extent of controlling the opening degree in an operating state, the indoor expansion valve (63*a* to 63*c*) is fully open in the operating state.

The outdoor controller (110) causes an initial value (e.g., 8.5 MPa) of the reference high pressure to be stored in the memory (112). In the heating operation, heating/refrigeration-facility operation, heating/refrigeration-facility heat recovery operation, and heating/refrigeration-facility residual heat operation, which are heat application operations, the outdoor controller (110) starts operation control of the outdoor unit (10) by using the initial value of the reference high pressure. In the heating/refrigeration-facility residual heat operation, the outdoor controller (110) maintains the reference high pressure to be the initial value. In the heating/refrigeration-facility heat recovery operation, the outdoor controller (110) maintains the reference high pressure to a value at start of the heating/refrigeration-facility heat recovery operation.

When the indoor expansion valve (63*a* to 63*c*) of at least one indoor unit (60*a* to 60*c*) is maintained to be fully open for a certain period of time during the heating and heating/refrigeration-facility operation, it can be determined that the heating capacity of the indoor units (60*a* to 60*c*) is insufficient for the heating load. Thus, when receiving of the fully opening signal from at least one indoor controller (115*a* to 115*c*) continues for a predetermined period of time (e.g., 1 minute) or more during the heating operation and heating/refrigeration-facility operation, the outdoor controller (110) increases the reference high pressure by only a predetermined value (e.g., 1 MPa) to increase the heating capacity of the indoor unit (60*a* to 60*c*) (see FIG. 9). The outdoor controller (110) controls operation of the compression section (C) or the outdoor fan (12) by using the increased reference high pressure. As a result, the heating capacity of the indoor unit (60*a* to 60*c*) increases.

When the indoor expansion valves (63*a* to 63*c*) of all the indoor units (60*a* to 60*c*) are not fully open after increasing the reference high pressure during the heating operation and heating/refrigeration-facility operation, it can be determined that the heating capacity of the indoor units (60*a* to 60*c*) is too larger for the heating load. Thus, when receiving of the fully opening signals from all the indoor controllers (115*a* to 115*c*) does not continue after increasing the reference high pressure during the heating operation and heating/refrigeration-facility operation, the outdoor controller (110) decreases the reference high pressure only by a predetermined value (e.g., 1 MPa) to decrease the heating capacity of the indoor units (60*a* to 60*c*) (see FIG. 9). The outdoor controller (110) controls operation of the compression section (C) or the outdoor fan (12) by using the decreased reference high pressure. As a result, the heating capacity of the indoor units (60*a* to 60*c*) decreases.

<Control Operation (6) of Outdoor Controller>

As illustrated in FIG. 9, in the heat application operation (specifically, the heating operation and heating/refrigeration-facility operation) where the outdoor heat exchanger (13) functions as an evaporator, the outdoor controller (110) controls the amount of airflow from the outdoor fan (12) and the operating capacity of the compression section (C). The outdoor controller (110) controls the amount of airflow from the outdoor fan (12) and the operating capacity of the compression section (C) so that the measured value HP obtained from the discharge pressure sensor (90) reaches the reference high pressure.

The outdoor controller (110) controls the amount of airflow from the outdoor fan (12) when the operating capacity of the compression section (C) is at minimum.

In the control of the outdoor fan (12), the outdoor controller (110) decreases the rotational speed of the outdoor fan (12) to decrease the amount of airflow from the outdoor fan (12) when the measured value HP obtained from the discharge pressure sensor (90) is higher than the reference high pressure (HP>the reference high pressure). The decrease in the amount of airflow from the outdoor fan (12) causes a decrease in the amount of heat absorbed by the refrigerant in the outdoor heat exchanger (13) which functions as an evaporator. As a result, the pressure of the refrigerant discharged from the compression section (C) decreases.

When the measured value HP obtained from the discharge pressure sensor (90) is lower than the reference high pressure (HP<the reference high pressure), the outdoor controller (110) increases the rotational speed of the outdoor fan (12) to increase the amount of airflow from the outdoor fan (12). The increase in the amount of airflow from the outdoor fan (12) causes an increase in the amount of heat absorbed by the refrigerant in the outdoor heat exchanger (13) which functions as an evaporator. As a result, the pressure of the refrigerant discharged from the compression section (C) increases.

When the measured value HP obtained from the discharge pressure sensor (90) continues to be lower than the reference high pressure even at the maximum rotational speed of the outdoor fan (12), the outdoor controller (110) controls the operating capacity of the compression section (C) with the maximum rotational speed of the outdoor fan (12) maintained.

When the measured value HP obtained from the discharge pressure sensor (90) is lower than the reference high pressure (HP<the reference high pressure) in the control of the compression section (C), the outdoor controller (110) increases the operation frequencies of the compressors (21, 22, 23) constituting the compression section (C) to increase the operating capacity of the compression section (C). The increase in the operating capacity of the compression section (C) causes an increase in the pressure of the refrigerant discharged from the compression section (C).

When the measured value HP obtained from the discharge pressure sensor (90) is higher than the reference high pressure (HP>the reference high pressure), the outdoor controller (110) decreases the operation frequencies of the compressors (21, 22, 23) constituting the compression section (C) to decrease the operating capacity of the compressed section (C). The decrease in the operating capacity of the compression section (C) decreases the pressure of the refrigerant discharged from the compression section (C).

When the measured value HP obtained from the discharge pressure sensor (90) continues to be higher than the reference high pressure even at the minimum operating capacity of the compression section (C), the outdoor controller (110) controls the amount of airflow from the outdoor fan (12) as mentioned above with the minimum operating capacity of the compression section (C) maintained.

As mentioned above, the outdoor controller (110) increases the operation frequencies of the compressors (21, 22, 23) constituting the compression section (C) to increase the operating capacity of the compression section (C) when the measured value HP obtained from the discharge pressure sensor (90) is lower than the reference high pressure even at the maximum rotational speed of the outdoor fan (12). In other words, the outdoor controller (110) is configured to preferentially increase the rotational speed of the outdoor fan (12) which consumes less power than the compressors (21, 22, 23) when the measured value HP obtained from the discharge pressure sensor (90) needs to be increased. Such a control operation performed by the outdoor controller (110) allows a decrease in the power consumption.

As mentioned above, the outdoor controller (110) decreases the rotational speed of the outdoor fan (12) to decrease the amount of airflow from the outdoor fan (12) when the measured value obtained from the discharge pressure sensor (90) is higher than the reference high pressure even at the minimum operating capacity of the compression section (C). In other words, the outdoor controller (110) is configured to preferentially decrease the operation frequencies of the compressors (21, 22, 23) which consume more power than the outdoor fan (12) when the measured value HP obtained from the discharge pressure sensor (90) needs to be decreased. Such a control operation performed by the outdoor controller (110) allows a decrease in the power consumption.

<Control Operation (7) of Outdoor Controller>

In the heating/refrigeration-facility operation, heating/refrigeration-facility heat recovery operation, and heating/refrigeration-facility residual heat operation, where the refrigeration-facility unit (50*a*, 50*b*) operate, the outdoor controller (110) controls the compression section (C) based on a refrigeration-facility reference low pressure stored in the memory and the measured value obtained from the first suction pressure sensor (91).

The outdoor controller (110) controls operation of the compression section (C) so that the measured value obtained from the first suction pressure sensor (91) reaches the reference low pressure. Specifically, the outdoor controller (110) controls the operating capacity of the second compressor (22) so that the measured value obtained from the first suction pressure sensor (91) falls within "a low pressure range including the refrigeration-facility reference low pressure (e.g., a range of the reference low pressure±150 kPa)."

When the measured value obtained from the first suction pressure sensor (91) exceeds the upper limit of the low pressure range (e.g., the reference low pressure+150 kPa), the outdoor controller (110) increases the operation frequency of the second compressor (22) to increase the operating capacity of the second compressor (22). The increase in the operating capacity of the second compressor (22) causes a decrease in the pressure of the refrigerant sucked into the second compressor (22). As a result, the evaporation temperature of the refrigerant in the refrigeration-facility heat exchanger (54) decreases.

When the measured value obtained from the first suction pressure sensor (91) falls below the lower limit of the low pressure range (e.g., the reference low pressure −150 kPa), the outdoor controller (110) decreases the operation frequency of the second compressor (22) to decrease the operating capacity of the second compressor (22). The decrease in the operating capacity of the second compressor (22) causes an increase in the pressure of the refrigerant sucked into the second compressor (22). As a result, the evaporation temperature of the refrigerant in the refrigeration-facility heat exchanger (54) increases.

<Control Operation (8) of Outdoor Controller>

In all the heating operation, heating/refrigeration-facility operation, heating/refrigeration-facility heat recovery operation, and heating/refrigeration-facility residual heat operation, which are heat application operations, the outdoor controller (110) controls operation of the compression section (C) based on a reference discharge temperature stored in the memory and a low-stage discharge temperature of the compression section (C).

In the heating operation in which the second compressor (22) is paused and the third compressor (23) operates, the outdoor controller (110) uses the measured value obtained from the second discharge temperature sensor (94) as the low-stage discharge temperature. In the heating/refrigeration-facility operation in which the second compressor (22) and third compressor (23) both operate, the outdoor controller (110) uses a higher one between the measured value obtained from the second discharge temperature sensor (94) and the measured value obtained from the third discharge temperature sensor as the low-stage discharge temperature. In the heating/refrigeration-facility heat recovery operation and heating/refrigeration-facility residual heat operation in which the second compressor (22) operates and the third compressor (23) is paused, the outdoor controller (110) uses the measured value obtained from the first discharge temperature sensor (93) as the low-stage discharge temperature.

The outdoor controller (110) controls operation of the compression section (C) so that the low-stage discharge temperature reaches the reference discharge temperature. Specifically, the outdoor controller (110) controls the operating capacity of the first compressor (21) so that the low-stage discharge temperature falls within a "fourth temperature range including the reference discharge temperature (e.g., a range of the reference discharge temperature ±0.15° C.)."

When the low-stage discharge temperature exceeds the upper limit of the fourth temperature range (e.g., the reference discharge temperature +0.15° C.), the outdoor controller (110) increases the operation frequency of the first compressor (21) to increase the operating capacity of the first compressor (21). The increase in the operating capacity of the first compressor (21) causes a decrease in the pressure of the refrigerant sucked into the first compressor (21). As a result, the pressure of the refrigerant discharged from the second compressor (22) or the third compressor (23) decreases, and the low-stage discharge temperature decreases.

When the low-stage discharge temperature falls below the lower limit of the fourth temperature range (e.g., the reference discharge temperature −0.15° C.), the outdoor controller (110) decreases the operation frequency of the first compressor (21) to decrease the operating capacity of the first compressor (21). The decrease in the operating capacity of the first compressor (21) causes an increase in the pressure of the refrigerant sucked into the first compressor (21). As a result, the pressure of the refrigerant discharged from the second compressor (22) or the third compressor (23) increases, and the low-stage discharge temperature increases.

<Control Operation (9) of Outdoor Controller>

As illustrated in FIG. 9, the outdoor controller (110) switches operation performed by the refrigeration apparatus (1) among the heating/refrigeration-facility residual heat operation, heating/refrigeration-facility heat recovery operation, and heating/refrigeration-facility operation.

When an excessive heating capacity condition indicating that the heating capacity is excessive for the heating load is satisfied with the refrigeration apparatus (1) performing the heating/refrigeration-facility heat recovery operation, the outdoor controller (110) switches the operation performed by the refrigeration apparatus (1) from the heating/refrigeration-facility heat recovery operation to the heating/refrigeration-facility residual heat operation. In the heating/refrigeration-facility residual heat operation, the refrigerant dissipates heat in both the indoor heat exchanger (64*a* to 64*c*) and the outdoor heat exchanger (13), thereby decreasing the heating capacity as compared with the heating/refrigeration-facility heat recovery operation.

The excessive heating capacity condition is a condition where at least one of a first condition where "the measured value HP obtained from the discharge pressure sensor (90) is higher than the reference high pressure (HP>the reference high pressure) and the indoor expansion valve (63*a* to 63*c*) of at least one indoor unit (60*a* to 60*c*) continues not to be fully open for at least one minute" or a second condition where "all the indoor units (60*a* to 60*c*) pause heating of air" is satisfied.

When an insufficient heating capacity condition indicating that the heating capacity is insufficient for the heating load is satisfied with the refrigeration apparatus (1) performing the heating/refrigeration-facility residual heat operation, the outdoor controller (110) switches the operation performed by the refrigeration apparatus (1) from the heating/refrigeration-facility residual heat operation to the heating/refrigeration-facility heat recovery operation. In the heating/refrigeration-facility heat recovery operation, the refrigerant in the indoor heat exchanger (64*a* to 64*c*) dissipates heat, and the outdoor heat exchanger (13) is paused, thereby increasing the heating capacity as compared with the heating/refrigeration-facility residual heat operation.

The insufficient heating capacity condition is a condition where at least one of a third condition where "the measured value HP obtained from the discharge pressure sensor (90) is lower than the reference high pressure (HP<the reference high pressure) or a fourth condition where "the indoor expansion valve (63*a* to 63*c*) of at least one indoor unit (60*a* to 60*c*) continues to be fully open for at least one minute" is satisfied.

When the insufficient heating capacity condition is satisfied with the refrigeration apparatus (1) performing the heating/refrigeration-facility heat recovery operation, the outdoor controller (110) switches operation performed by the refrigeration apparatus (1) from the heating/refrigeration-facility heat recovery operation to the heating/refrigeration-facility operation. In the heating/refrigeration-facility operation, the refrigerant in both the refrigeration-facility heat exchanger (54) and the outdoor heat exchanger (13) absorbs heat, thereby increasing the heating capacity as compared with the heating/refrigeration-facility heat recovery operation.

When the excessive heating capacity condition is satisfied with the refrigeration apparatus (1) performing the heating/refrigeration-facility operation, the outdoor controller (110) switches operation performed by the refrigeration apparatus (1) from the heating/refrigeration-facility operation to the heating/refrigeration-facility heat recovery operation. In the heating/refrigeration-facility heat recovery operation, the refrigerant in the refrigeration-facility heat exchanger (54) absorbs heat and the outdoor heat exchanger (13) is paused, thereby decreasing the heating capacity as compared with the heating/refrigeration-facility operation.

—Feature (1) of Embodiment—

The refrigeration apparatus (1) of the present embodiment includes a refrigerant circuit (6) and a controller (100). The refrigerant circuit (6) includes a compressor (21, 22, 23), an indoor heat exchanger (64*a* to 64*c*), and a plurality of indoor units (60*a* to 60*c*), and performs a refrigeration cycle in which a high pressure is equal to or greater than the critical pressure of a refrigerant. The indoor units (60*a* to 60*c*) are provided with indoor heat exchangers (64*a* to 64*c*) and expansion valves (63*a* to 63*c*), respectively. The refrigeration apparatus (1) performs at least a heat application operation in which the indoor heat exchanger (64*a* to 64*c*) functions as a radiator.

Each indoor unit (60*a* to 60*c*) in the refrigeration apparatus (1) of the present embodiment applies heat to a target space in the heat application operation so that the temperature of the target space reaches the set temperature. The plurality of indoor units (60*a* to 60*c*) are capable of separately set the respective set temperatures.

The refrigeration apparatus (1) of the present embodiment further includes a controller (100). The controller (100) uses a temperature higher than the highest set temperature among the set temperatures for the plurality of indoor units (60*a* to 60*c*) as a reference temperature in the heat application operation. The controller (100) separately controls the opening degree of the expansion valve (63*a* to 63*c*) of the indoor unit (60*a* to 60*c*) so that the temperature of the refrigerant at the outlet of the indoor heat exchanger (64*a* to 64*c*) of the indoor unit (60*a* to 60*c*) reaches the reference temperature.

In the refrigeration apparatus (1) of the present embodiment, the controller (100) compares the set temperatures for the indoor units (60*a* to 60*c*) and sets the reference temperature to be higher than the highest set temperature. The controller (100) controls the expansion valve (63*a* to 63*c*) of the indoor unit (60*a* to 60*c*) using this reference temperature.

As a result, the difference among the opening degrees of the expansion valves (63*a* to 63*c*) of the respective indoor units (60*a* to 60*c*) becomes relatively small, and the difference among the amounts of refrigerant accumulated in the indoor heat exchangers (64*a* to 64*c*) of the respective indoor units (60*a* to 60*c*) becomes small. This aspect allows the amount of refrigerant circulating in the refrigerant circuit (6) to be ensured, and applying heat to an object in the indoor heat exchanger (64*a* to 64*c*) to be performed appropriately.

—Feature (2) of Embodiment—

In the refrigeration apparatus (1) of the present embodiment, the controller (100) controls the operating capacity of the third compressor (23) so that the high pressure of the refrigeration cycle reaches a predetermined reference high pressure, if the outdoor heat exchanger (13) functions as an evaporator during the heat application operation. The heat application operation in which the outdoor heat exchanger (13) functions as an evaporator includes the heating operation and the heating/refrigeration-facility operation.

In the refrigeration apparatus (1) of the present embodiment, the controller (100) controls the operating capacity of the third compressor (23). If the indoor heat exchanger (64*a* to 64*c*) functions as a radiator and the outdoor heat exchanger (13) functions as an evaporator during the heat application operation, the controller (100) controls the operating capacity of the third compressor (23) so that the high pressure of the refrigeration cycle reaches the reference high pressure.

—Feature (3) of Embodiment—

In the refrigeration apparatus (1) of the present embodiment, the controller (100) increases the reference high pressure when the indoor expansion valve (63*a* to 63*c*) of at least one indoor unit (60*a* to 60*c*) is fully open, and decreases the reference high pressure when the indoor expansion valves (63*a* to 63*c*) of all the indoor units (60*a* to 60*c*) are not fully open, if the outdoor heat exchanger (13) functions as an evaporator in the heat application operation. The heat application operation in which the outdoor heat exchanger (13) functions as an evaporator includes the heating operation and the heating/refrigeration-facility operation.

In the refrigeration apparatus (1) of the present embodiment, the controller (100) controls the reference high pressure used to control the third compressor (23). The controller (100) controls the reference high pressure based on the state of the indoor expansion valve (63*a* to 63*c*), if the indoor heat exchanger (64*a* to 64*c*) functions as a radiator and the outdoor heat exchanger (13) functions as an evaporator during the heat application operation.

Thus, in the present embodiment, the control of the reference high pressure based on the states of the indoor expansion valve (63*a* to 63*c*) of the indoor circuit (61*a* to 61*c*) by the controller (100) allows the indoor units (60*a* to 60*c*) to exhibit an appropriate heating capacity for the heating load in the room.

—Feature (4) of Embodiment—

In the refrigeration apparatus (1) of the present embodiment, the refrigerant circuit (6) includes a refrigeration-facility heat exchanger (54) which can function as an evaporator during the heat application operation and an outdoor expansion valve (14) provided to be associated with the outdoor heat exchanger (13) and having a variable opening degree.

The controller (100) of the present embodiment controls the opening degree of the outdoor expansion valve (14) so that the temperature of the refrigerant at the outlet of the outdoor heat exchanger (13) reaches the predetermined heat-source-side reference temperature, if the outdoor heat exchanger (13) functions as a radiator and the refrigeration-facility heat exchanger (54) functions as an evaporator in the heat application operation. The heat application operation in which the outdoor heat exchanger (13) functions as a radiator and the refrigeration-facility heat exchanger (54) functions as an evaporator is a heating/refrigeration-facility residual heat operation.

In the refrigeration apparatus (1) of the present embodiment, the controller (100) controls the opening degree of the outdoor expansion valve (14). If the indoor heat exchanger (64*a* to 64*c*) and outdoor heat exchanger (13) each function as a radiator and the refrigeration-facility heat exchanger (54) functions as an evaporator during the heat application operation, the controller (100) controls the opening degree of the outdoor expansion valve (14) so that the temperature of the refrigerant at the outlet of the outdoor heat exchanger (13) reaches a predetermined heat-source-side reference temperature. In this case, the controller (100) controls the opening degree of the indoor expansion valve (63*a* to 63*c*) so that the temperature of the refrigerant at the outlet of the indoor heat exchanger (64*a* to 64*c*) reaches the reference temperature.

—Feature (5) of Embodiment—

The refrigeration apparatus (1) of the present embodiment includes an outdoor fan (12) for sending outdoor air to the outdoor heat exchanger (13). The outdoor heat exchanger (13) is configured to exchange heat between outdoor air send from the outdoor fan (12) and the refrigerant. The refrigerant circuit (6) includes a refrigeration-facility heat exchanger (54) which can function as an evaporator during the heat application operation.

The controller (100) of the present embodiment controls the amount of air sent from the outdoor fan (12) so that the high pressure of the refrigeration cycle reaches a predetermined reference high pressure, if the outdoor heat exchanger (13) functions as a radiator and the refrigeration-facility heat exchanger (54) functions as an evaporator in the heat application operation. The heat application operation in which the outdoor heat exchanger (13) functions as a radiator and the refrigeration-facility heat exchanger (54) functions as an evaporator is a heating/refrigeration-facility residual heat operation.

In the refrigeration apparatus (1) of the present embodiment, the controller (100) controls the amount of air sent from the outdoor fan (12). The controller (100) controls the amount of airflow from the outdoor fan (12) so that the high pressure of the refrigeration cycle reaches the reference high pressure, if the indoor heat exchanger (64*a* to 64*c*) and outdoor heat exchanger (13) each function as a radiator and the refrigeration-facility heat exchanger (54) functions as an evaporator during the heat application operation.

Variations of Embodiment

First Variation

The refrigeration apparatus (1) of the present embodiment may include an outdoor unit (10) and indoor units (60*a* to 60*c*) and may not include refrigeration-facility units (50*a*, 50*b*). The refrigeration apparatus (1) of this variation constitutes an air conditioner that exclusively conditions indoor air. The outdoor unit (10) constituting the refrigeration apparatus (1) of this variation includes no second compressor (22).

Second Variation

The utilization-side unit in the refrigeration apparatus (1) of the present embodiment is not limited to the indoor unit (60*a* to 60*c*) which performs air conditioning in a room. In the refrigeration apparatus (1) of the present embodiment, the utilization-side unit may be configured to apply heat to or cool water by the refrigerant. In the utilization-side unit of the present variation, the heat exchanger which exchanges heat between the refrigerant and water is provided as an utilization-side heat exchanger.

The utilization-side unit of the present variation performs a heat application operation in which heat is applied to water which is a target to be heated in the utilization-side heat exchanger, by using the refrigerant. In this heat application operation, the utilization-side unit applies heat to water which is a target to be heated, by using the refrigerant so that the temperature of the water at the outlet of the utilization-side heat exchanger reaches the set temperature. The set temperature set for the utilization-side unit of the present variation is a target value of the temperature of the water (the target to be heated) at the outlet of the utilization-side heat exchanger. In the refrigeration apparatus (1) of the present variation, the outdoor controller (110) sets the reference temperature used by each indoor controller (115*a* to 115*c*) in control of the indoor expansion valve (63*a* to 63*c*) to be higher than the set temperature for the temperature of the object (water in this variation) heated in the utilization-side heat exchanger.

Third Variation

In the refrigeration apparatus (1) of the present embodiment, the compression section (C) performs two-stage compression where the refrigerant is compressed by the second or third compressor and the first compressor in order. However, this compression section (C) may include a single compressor or a plurality of compressors connected in parallel and may be configured to perform single-stage compression.

Fourth Variation

The refrigeration apparatus (1) of the present embodiment may include, as an utilization-side unit, a heat application unit that applies heat to the inside air in a heating cabinet. This heat application unit is targeted for an internal space of the heating cabinet, and blows air heated in its utilization-side heat exchanger (64*a* to 64*c*) into the internal space so that the temperature of the internal space (specifically, the ambient temperature of the internal space) reaches the set temperature.

While the embodiment and variations thereof have been described above, it will be understood that various changes in form and details may be made without departing from the spirit and scope of the claims. The foregoing embodiment and variations thereof may be combined and replaced with each other without deteriorating the intended functions of the present disclosure.

INDUSTRIAL APPLICABILITY

As can be seen from the foregoing description, the present disclosure is useful for a refrigeration apparatus.

EXPLANATION OF REFERENCES

1 Refrigeration Apparatus
6 Refrigerant Circuit
12 Outdoor Fan
14 Heat-Source-Side Expansion Valve
13 Heat-Source-Side Heat Exchanger
21 First Compressor (Compressor)
22 Second Compressor (Compressor)
23 Third Compressor (Compressor)
54 Refrigeration-Facility Heat Exchanger (Cooling Heat Exchanger)
60*a* First Indoor Unit (Utilization-Side Unit)
60*b* Second Indoor Unit (Utilization-Side Unit)
60*c* Third Indoor Unit (Utilization-Side Unit)
61*a* First Indoor Circuit (Utilization-Side Circuit)
61*b* Second Indoor Circuit (Utilization-Side Circuit)
61*c* Third Indoor Circuit (Utilization-Side Circuit)
64*a* First Indoor Heat Exchanger (Utilization-Side Heat Exchanger)
64*b* Second Indoor Heat Exchanger (Utilization-Side Heat Exchanger)
64*c* Third Indoor Heat Exchanger (Utilization-Side Heat Exchanger)
63*a* First Indoor Expansion Valve (Expansion Valve)
63*b* Second Indoor Expansion Valve (Expansion Valve)
63*c* Third Indoor Expansion Valve (Expansion Valve)
100 Controller

The invention claimed is:

1. A refrigeration apparatus including a refrigerant circuit that includes a compressor, a heat-source-side heat exchanger, and a plurality of utilization-side units each including an utilization-side heat exchanger and an expansion valve and arranged in parallel, the refrigerant circuit being configured to perform a refrigeration cycle where a high pressure is equal to or greater than a critical pressure of a refrigerant, each of the plurality of utilization-side units being configured to perform an operation in which the utilization-side heat exchanger functions as a radiator, and an operation in which the utilization-side heat exchanger functions as an evaporator, the refrigeration apparatus being configured to perform at least a heat application operation in which all of the utilization-side heat exchangers function as a radiator, wherein the plurality of utilization-side units are capable of separately setting respective set temperatures, the refrigeration apparatus further comprises a controller configured to set a reference temperature higher than the highest set temperature among the set temperatures for the plurality of utilization-side units, and separately control an opening degree of the expansion valve of each of the plurality of utilization-side units so that a temperature of the refrigerant at an outlet of the utilization-side heat exchanger of each of the plurality of utilization-side units reaches the reference temperature, in the heat application operation, and control of the opening degrees of the expansion valves of the plurality of utilization-side units on a basis of the set reference temperature reduces a difference among amounts of refrigerant accumulated in the plurality of utilization-side heat exchangers of the respective plurality of utilization-side units.

2. The refrigeration apparatus of claim 1, wherein the controller controls an operating capacity of the compressor so that a high pressure of the refrigeration cycle reaches a predetermined reference high pressure when the heat-source-side heat exchanger functions as an evaporator in the heat application operation.

3. The refrigeration apparatus of claim 2, wherein the controller increases the reference high pressure if the expansion valve of at least one of the utilization-side units is fully open, and decreases the reference high pressure if the expansion valves of all the utilization-side units are not fully open, when the heat-source-side heat exchanger functions as an evaporator in the heat application operation.

4. The refrigeration apparatus of claim 1, wherein the refrigerant circuit further includes a cooling heat exchanger capable of functioning as an evaporator during the heat application operation, and a heat-source-side expansion valve provided to be associated with the heat-source-side heat exchanger and having a variable opening degree, and the controller controls the opening degree of the heat-source-side expansion valve so that the temperature of the refrigerant at the outlet of the heat-source-side heat exchanger reaches a predetermined heat-source-side reference temperature, when the heat-source-side heat exchanger functions as a radiator and the cooling heat exchanger functions as an evaporator in the heat application operation.

5. The refrigeration apparatus of claim 1, further comprising:

an outdoor fan for sending outdoor air to the heat-source-side heat exchanger, wherein the heat-source-side heat exchanger is configured to exchange heat between outdoor air send from the outdoor fan and the refrigerant, the refrigerant circuit further includes a cooling heat exchanger capable of functioning as an evaporator during the heat application operation, and the controller controls an amount of air sent from the outdoor fan so that a high pressure of the refrigeration cycle reaches a predetermined reference high pressure when the heat-source-side heat exchanger functions as a radiator and the cooling heat exchanger functions as an evaporator in the heat application operation.

* * * * *